US010241444B2

(12) United States Patent
Okamura et al.

(10) Patent No.: US 10,241,444 B2
(45) Date of Patent: Mar. 26, 2019

(54) DEVELOPING DEVICE AND IMAGE FORMING APPARATUS FOR EFFICIENT EQUALIZATION OF DEVELOPER ALONG A DEVELOPING DEVICE

(71) Applicant: Konica Minolta, Inc., Chiyoda-ku, Tokyo (JP)

(72) Inventors: Kei Okamura, Kanagawa (JP); Shunichi Takaya, Tokyo (JP); Hideaki Tanaka, Tokyo (JP); Kazuteru Ishizuka, Saitama (JP); Shota Sakurai, Tokyo (JP); Kei Yuasa, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/728,593

(22) Filed: Oct. 10, 2017

(65) Prior Publication Data

US 2018/0107137 A1 Apr. 19, 2018

(30) Foreign Application Priority Data

Oct. 13, 2016 (JP) ..... 2016-201867
Oct. 26, 2016 (JP) ..... 2016-209726

(51) Int. Cl.
*G03G 15/08* (2006.01)
*G03G 15/10* (2006.01)

(52) U.S. Cl.
CPC ..... *G03G 15/105* (2013.01); *G03G 15/0893* (2013.01)

(58) Field of Classification Search
CPC ..... G03G 15/105; G03G 15/0824; G03G 15/0891; G03G 15/0836
USPC ..... 399/238
See application file for complete search history.

(56) References Cited

U.S. PATENT DOCUMENTS 8,412,077 B2 * 4/2013 Ishiguro ..... G03G 15/0887 399/254
2007/0140744 A1 * 6/2007 Akedo ..... G03G 15/0893 399/254
2011/0236074 A1 * 9/2011 Maeda ..... G03G 15/0893 399/254

FOREIGN PATENT DOCUMENTS

JP 50-27333 Y1 8/1975
JP 03-260678 A 11/1991
JP 2001092263 A * 4/2001

* cited by examiner

*Primary Examiner* — Walter L Lindsay, Jr.
*Assistant Examiner* — Arlene Heredia
(74) *Attorney, Agent, or Firm* — Buchanan Ingersoll & Rooney PC

(57) ABSTRACT

A developing device includes a hardware processor that performs control in which a developer circulation state is switched between a first state and a second state depending on states of the developer in the first and the second regions. The first state is a state in which a developer circulation path is formed in each of the first and the second regions, and the second state is a state in which a single developer circulation path is formed all through the first and the second regions.

27 Claims, 23 Drawing Sheets

DEVELOPING DEVICE AND IMAGE FORMING APPARATUS FOR EFFICIENT EQUALIZATION OF DEVELOPER ALONG A DEVELOPING DEVICE

CROSS REFERENCE TO RELATED APPLICATIONS

Japanese Patent Application No. 2016-201867 filed on Oct. 13, 2016 and No. 2016-209726 filed on Oct. 26, 2016, including description, claims, drawings, and abstract the entire disclosure are incorporated herein by reference in their entireties.

BACKGROUND

Technological Field

The present invention relates to a developing device and an image forming apparatus.

Description of Related Art

In general, an electrophotographic image forming apparatus (such as a printer, a copier, or a fax machine) is configured to irradiate (expose) a charged photoconductor drum (image bearing member) with (to) laser light based on image data to form an electrostatic latent image on the surface of the photoconductor. The electrostatic latent image is then visualized by supplying toner from a developing device to the photoconductor drum on which the electrostatic latent image is formed, whereby a toner image is formed. Further, the toner image is directly or indirectly transferred to a sheet, and then heat and pressure are applied to the sheet at a fixing nip to form a toner image on the sheet.

The developing device is provided with a stirring member for stirring developer in the developing device. A configuration of the stirring member with which the developer is stirred to move in the axial direction of a developing sleeve is known. In such a configuration, in the case where the size of the developing device is increased to process sheets which are long in the axial direction such as a B1 sheet, a problem arises in that deviations in toner density are liable to be large along the axial direction since the toner is mixed from the upstream side in the moving direction of the developer.

Japanese Examined Utility Model (Registration) Application Publication No. S50-27333, for example, discloses a configuration in which developer is circulated in respective half regions on one side and on the other side of the developing device along the axial direction for the purpose of solving this problem. FIG. 1 illustrates the developing device in the conventional example in a simplified manner.

As illustrated in FIG. 1, developing device 412 includes developing sleeve 412A and developer housing 412B. Developer housing 412B includes therein first stirring member 412C and second stirring member 412D which stir the developer in developer housing 412B.

First stirring member 412C and second stirring member 412D are configured to include blades which are oriented in opposite directions in first region B1 on one side and in second region B2 on the other side with respect to the central portion along the axial direction of developing sleeve 412A, respectively. First stirring member 412C and second stirring member 412D rotate so as to cause circulation of the developer in each of first and second regions B1 and B2 along flows indicated by arrows B10 and B20.

In addition, Japanese Patent Application Laid-Open No. H3-260678 discloses a configuration in which developer is actively caused to flow at the boundary between first and second regions B1 and B2 into both sides of first and second regions B1 and B2, so that occurrence of a difference in toner density between first and second regions B1 and B2 can be prevented.

SUMMARY

In the configuration disclosed in Japanese Examined Utility Model (Registration) Application Publication No. 50-27333, however, when images in which one part of the image corresponding to one of first and second regions B1 and B2 has an extremely greater amount of toner than the other part corresponding to the other region are consecutively formed, for example, a problem may arise in that the states of the developer in first and second regions B1 and B2 cannot be equalized due to an extreme decrease in toner density only in the one part corresponding to one of the regions.

In addition, in the configuration disclosed in Japanese Patent Application Laid-Open No. 3-260678, the toner density in one of first and second regions B1 and B2 decreases extremely when the above-mentioned images are formed consecutively, and consequently, an extreme decrease in toner density is caused also in the other region. This causes a decrease in toner density in the entire developing device at an early stage of the image formation process of the above-mentioned images, so that the recovery of toner density in the entire developing device takes time. That is, equalization of the states of the developer in first and second regions B1 and B2 takes time.

In a case where first and second regions B1 and B2 are separated from each other by a partition, the carrier consumptions of when there arises a poor charge condition and the amounts of degraded developer of when images of low coverage are consecutively formed each differ between first and second regions B1 and B2. Accordingly, it is difficult to equalize, entirely along the axial direction of the developing device, the states of the developer (deviations in amount of developer and/or amounts of degraded developer) in first and second regions B1 and B2.

An object of the present invention is to provide a developing device and an image forming apparatus which enable efficient equalization of a developer entirely along the axial direction of the developing device.

A developing device in which one aspect of the present invention is reflected in an attempt to at least partly achieve the above-mentioned object includes: a developer bearing member that bears a developer; a developer housing that stores the developer to be supplied to the developer bearing member, the developer housing including a first region on one side in an axial direction of the developer bearing member and a second region on the other side; and a hardware processor that performs control in which a developer circulation state is switched between a first state and a second state depending on states of the developer in the first and the second regions, the first state being a state in which a developer circulation path is formed in each of the first and the second regions, the second state being a state in which a single developer circulation path is formed all through the first and the second regions.

An image forming apparatus in which one aspect of the present invention is reflected in an attempt to at least partly achieve the above-mentioned object includes: a developer bearing member that bears a developer; a developer housing that stores the developer to be supplied to the developer bearing member, the developer housing including a first region on one side in an axial direction of the developer bearing member and a second region on the other side; and a hardware processor that performs control in which a developer circulation state is switched between a first state and a second state depending on states of the developer in the first and the second regions, the first state being a state in which a developer circulation path is formed in each of the first and the second regions, the second state being a state in which a single developer circulation path is formed all through the first and the second regions.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
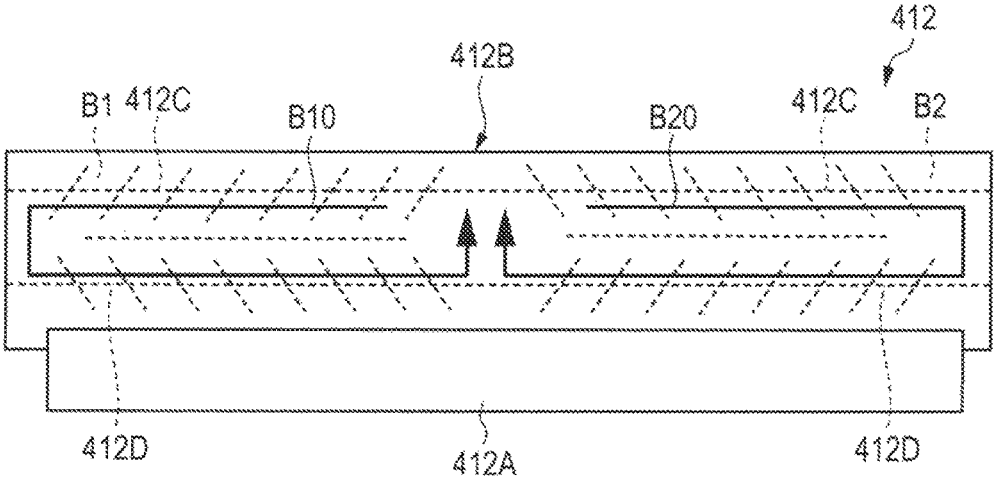
FIG. 1 is a simplified view of a developing device in a conventional example.
Figure 2:
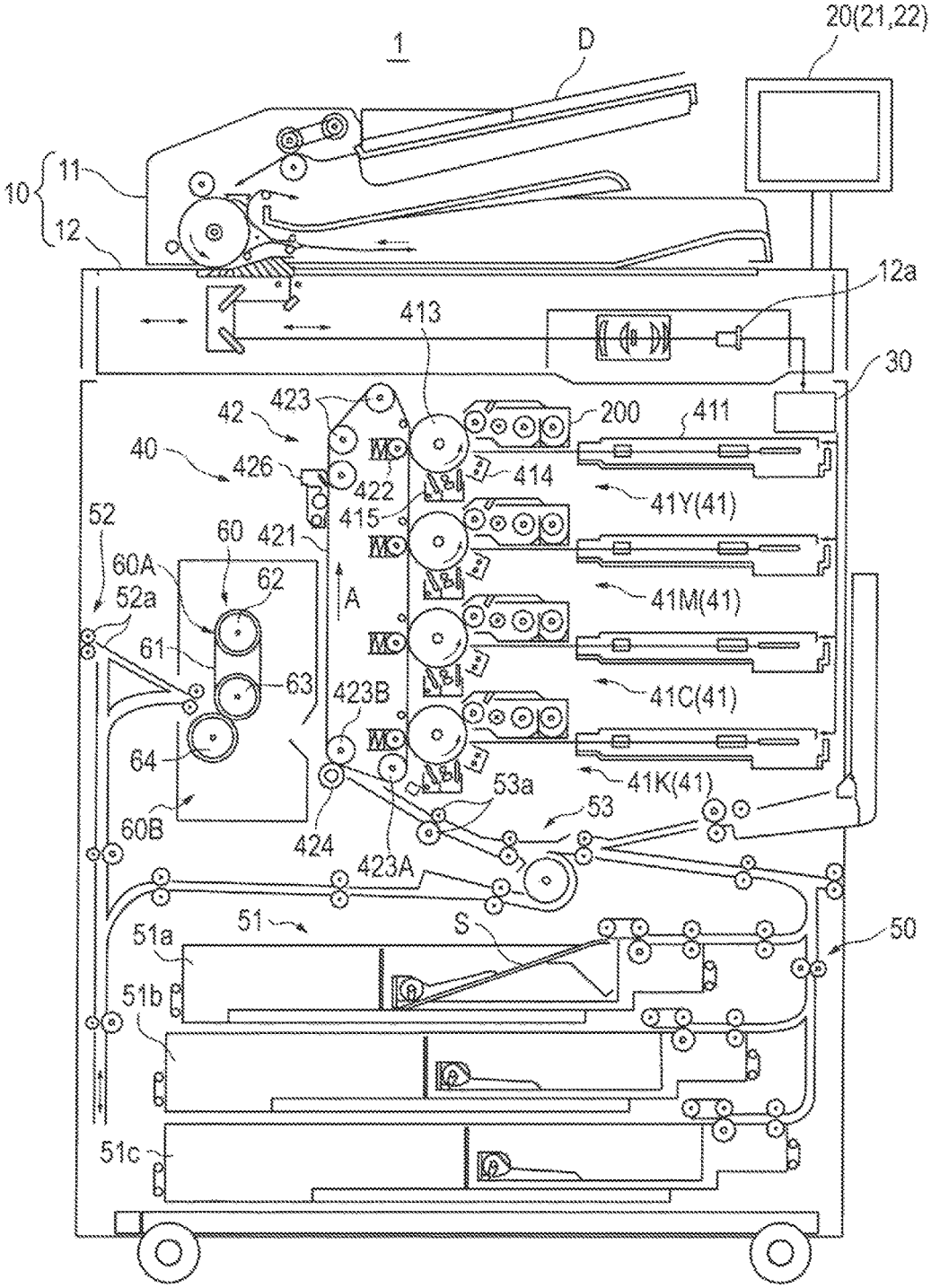
FIG. 2 schematically illustrates an entire configuration of an image forming apparatus according to an embodiment of the present invention.
Figure 3:
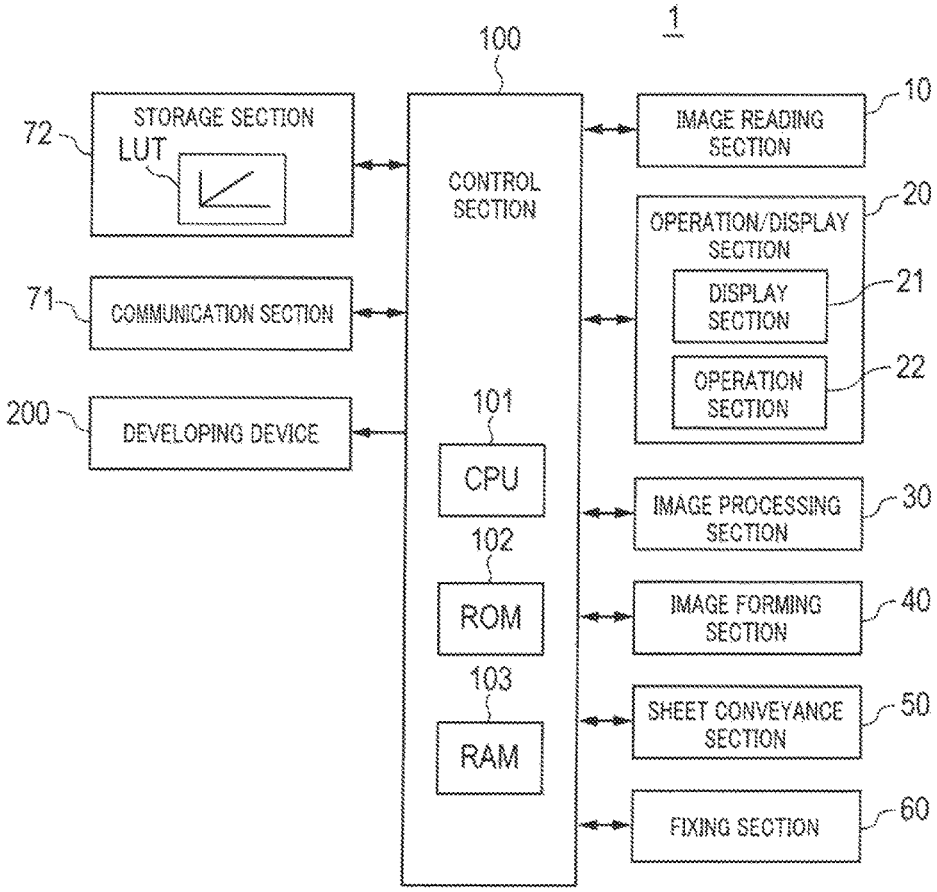
FIG. 3 illustrates a principal part of a control system of the image forming apparatus according to the embodiment of the present invention.

Hereinafter, an embodiment of the invention is described in detail based on the drawings. FIG. 2 schematically illustrates an entire configuration of image forming apparatus 1 according to an embodiment of the present invention. FIG. 3 illustrates a principal part of a control system of image forming apparatus 1 according to the embodiment of the present invention.

Image forming apparatus 1 illustrated in FIGS. 2 and 3 is a color image forming apparatus of an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 secondary-transfers the resultant image to sheet S, thereby forming an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

Image forming apparatus 1 includes image reading section 10, operation/display section 20, image processing section 30, image forming section 40, sheet conveyance section 50, fixing section 60, and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data (input image data) transmitted from the external apparatus, and performs control to form an image on sheet S on the basis of the image data. Communication section 71 is composed of, for example, a communication control card such as a LAN card.

Image reading section 10 includes auto document feeder (ADF) 11, document image scanning device 12 (scanner), and the like.

Auto document feeder 11 conveys, with a conveyance mechanism, document D placed on a document tray, to send out document D to document image scanner 12. Auto document feeder 11 makes it possible to successively read at once images (even both sides thereof) of a large number of documents D placed on the document tray.

Document image scanner 12 optically scans a document conveyed from auto document feeder 11 onto a contact glass or a document placed on the contact glass, and images reflected light from the document on a light receiving surface of charge coupled device (CCD) sensor 12*a* to read the document image Image reading section 10 generates input image data based on results read by document image scanner 12. The input image data undergo predetermined image processing in image processing section 30.

Operation/display section 20 includes, for example, a liquid crystal display (LCD) provided with a touch panel, and functions as display section 21 and operation section 22. Display section 21 displays various operation screens, image conditions, operating statuses of each function, information about the inside of image forming apparatus 1, and/or the like in accordance with display control signals input from control section 100. Operation section 22 equipped with various operation keys, such as a numeric keypad and a start key, receives various input operations by users and outputs operation signals to control section 100.

Image processing section 30 includes a circuit and/or the like that performs digital image processing of input image data in accordance with default settings or user settings. For example, image processing section 30 performs tone correction based on tone correction data (tone correction table) under the control of control section 100. Moreover, image processing section 30 performs various correction processing, such as color correction or shading correction, in addition to tone correction, and, compression processing, and the like of input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For convenience in illustration and description, common elements are denoted by the same reference signs and such reference signs are accompanied by Y, M, C, or K when they are to be distinguished. In FIG. 2, reference signs are given to only the elements of image forming unit 41Y for the Y component, and reference signs are omitted for the elements of other image forming units 41M, 41C, and 41K.

Image forming unit 41 includes exposing device 411, developing device 200, photoconductor drum 413, charging device 414, drum cleaning device 415 and the like.

Photoconductor drum 413 is a negative-charging type organic photoconductor (OPC) formed by sequentially laminating an undercoat layer (UCL), a charge generation layer (CGL), and charge transport layer (CTL) on a peripheral surface of a conductive cylindrical body made of aluminum (aluminum pipe as a raw material), for example.

Charging device 414 evenly and negatively charge the surface of photoconductor drum 413 having photoconductivity by generating corona discharge.

Exposing device 411 is composed of, for example, a semiconductor laser, and configured to irradiate photoconductor drum 413 with laser light corresponding to the image of each color component. Positive charges are generated in the charge generation layer of photoconductor drum 413 and transported to the surface of the charge transport layer, whereby the surface charges (negative charges) of photoconductor drum 413 are neutralized. Electrostatic latent images of respective color components are formed on the surface of photoconductor drum 413 due to potential differences from the surroundings.

Developing device 200 is a developing device of a two-component counter-rotation type, and attaches toners of respective color components to the surface of photoconductor drums 413, and visualizes the electrostatic latent image to form a toner image. Developing device 200 forms a toner image on the surface of photoconductor drum 413 by supplying the toner included in the developer to photoconductor drum 413.

Drum cleaning device 415 includes a drum cleaning blade that is brought into sliding contact with the surface of photoconductor drum 413, and removes transfer residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426, and the like.

Intermediate transfer belt 421 is composed of an endless belt, and is wound under tension around the plurality of support rollers 423 in a loop form. At least one of the plurality of support rollers 423 is composed of a driving roller, and the others are each composed of a driven roller. Intermediate transfer belt 421 travels in direction A at a constant speed by rotation of a driving roller. Intermediate transfer belt 421 is a conductive and elastic belt and driven into rotation with a control signal from control section 100.

Primary transfer rollers 422 are disposed on the inner peripheral surface side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

Belt cleaning device 426 removes transfer residual toner which remains on the surface of intermediate transfer belt 421 after a secondary transfer.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear surface side, that is, a side of intermediate transfer belt 421 that makes contact with primary transfer rollers 422 whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to backup roller 423B, and an electric charge of the polarity identical to the polarity of the toner is applied to the front surface side, that is, a side of sheet S that makes contact with intermediate transfer belt 421 whereby the toner image is electrostatically transferred to sheet S.

Fixing section 60 includes upper fixing section 60A having a fixing-surface-side member disposed on a side of the surface of sheet S on which a toner image is formed, that is, on a fixing surface side of sheet S, lower fixing section 60B having a rear-surface-side supporting member disposed on a side of the surface of sheet S opposite to the fixing surface, that is, on the rear surface side of sheet S, and the like. The rear-surface-side supporting member is brought into pressure contact with the fixing-surface-side member, whereby a fixing nip for conveying sheet S in a tightly sandwiching manner is formed.

At the fixing nip, fixing section 60 applies heat and pressure to sheet S on which a toner image has been secondary-transferred and which is conveyed to the fixing nip, so as to fix the toner image on sheet S.

Upper fixing section 60A includes endless fixing belt 61, heating roller 62 and fixing roller 63, which serve as the fixing-surface-side member. Fixing belt 61 is wound under tension around heating roller 62 and fixing roller 63.

Lower fixing section 60B includes pressure roller 64 that is the rear-surface-side supporting member. Together with fixing belt 61, pressure roller 64 forms a fixing nip for conveying sheet S in a sandwiching manner.

Sheet conveyance section 50 includes sheet feeder 51, sheet ejection section 52, conveyance path section 53 and the like. Three sheet feeding tray units 51*a* to 51*c*, which constitute sheet feeding section 51, store sheets S classified based on basis weight, size, or the like (standard paper, special paper) in accordance with predetermined types.

Conveying path section 53 includes a plurality of conveying roller pairs, such as registration roller pairs 53*a*. Sheets S stored in sheet feeding tray units 51*a* to 51*c* are sent out one by one from the top one and conveyed to image forming section 40 through conveying path section 53. At this time, the registration roller section in which registration roller pairs 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

Figure 4:
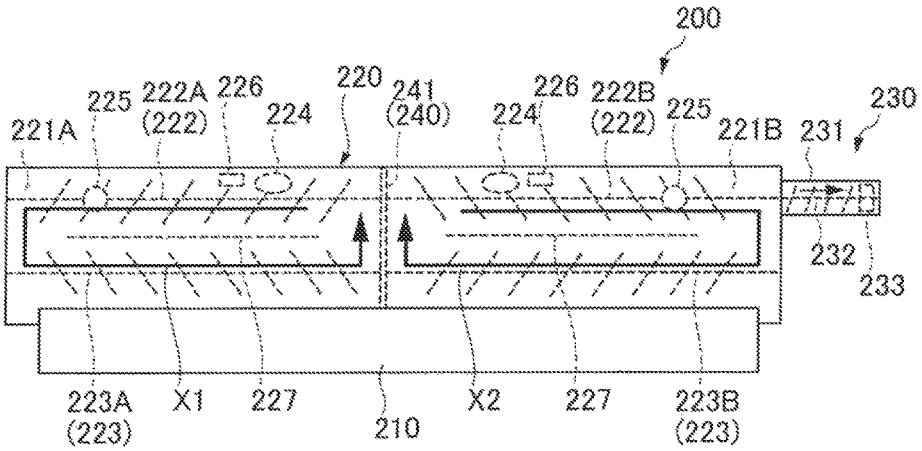
FIG. 4 illustrates a developing device as seen from above, in which an openable/closable section is in a closed state.
Figure 5:
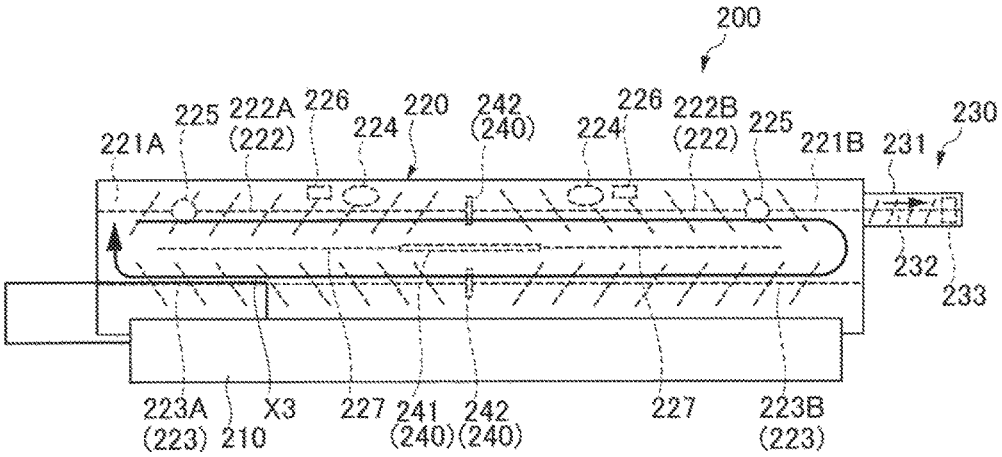
FIG. 5 illustrates the developing device as seen from above, in which the openable/closable section is in an opened state.

Next, developing device 200 is described in detail. FIG. 4 illustrates developing device 200 as seen from above, in which openable/closable section 240 is in a closed state. FIG. 5 illustrates developing device 200 as seen from above, in which openable/closable section 240 is in an opened state.

As illustrated in FIGS. 4 and 5, developing device 200 has a size that allows for processing of sheets which are long in the axial direction, such as a B1 sheet, and includes developing sleeve 210, developer housing 220, and developer discharging section 230. Developing sleeve 210 is a developer bearing member which bears developer, and has a length corresponding to sheets which are long in the axial direction. It is to be noted that the diameter of developing sleeve 210 is set to 25 mm in the present embodiment.

Developer housing 220 stores developer to be supplied to developing sleeve 210. Developer housing 220 includes openable/closable section 240 located between first region 221A and second regions 221B. First region 221A is a region on one side of developer housing 220 with respect to a portion of developer housing 220 corresponding to a central portion of developing sleeve 210 in the axial direction, and second region 221B is a region on the other side of developer housing 220 with respect to the portion corresponding to the central portion of developing sleeve 210 in the axial direction. Openable/closable section 240 corresponds to the "communication state switching section" of the present invention. In the meantime, the amount of developer that can be stored in developer housing 220 is 1,200 g in the present embodiment.

In addition, each of first and second regions 221A and 221B of developer housing 220 includes first stirring member 222, second stirring member 223, toner density detector 224, toner replenisher 225, and liquid level detector 226. First stirring member 222A and second stirring member 223A in first region 221A correspond to a "first stirrer" of the present invention. First stirring member 222B and second stirring member 223B in second region 221B correspond to a "second stirrer" of the present invention.

First stirring member 222 is provided at a part in first and second regions 221A and 221B that is farther away from developing sleeve 210 than second stirring member 223.

Second stirring member 223 is provided at a part in first and second regions 221A and 221B facing developing sleeve 210.

It is to be noted that the diameters of first and second stirring members 222 and 223 are set to 25 mm and their rotational frequencies are set to 450 rpm in the present embodiment.

In addition, each of first and second regions 221A and 221B is partitioned by diaphragm 227 into regions of first and second stirring members 222 and 223. Each of first and second regions 221A and 221B is partitioned by diaphragm 227 into the regions of first and second stirring members 222 and 223, but the regions of first and second stirring members 222 and 223 are communicated with each other at places corresponding to the ends of first and second stirring members 222 and 223.

First and second stirring members 222 and 223 stir the developer in first and second regions 221A and 221B depending on the state of operable/closable section 240 described below, such that the developer moves in the directions of arrows X1 and X2 in FIG. 4 or in the direction of arrow X3 in FIG. 5.

Toner density detectors 224 detect the toner densities in first and second regions 221A and 221B. Toner replenishers 225 replenish first and second regions 221A and 221B with toner, respectively. Control section 100 controls the toner replenishment amounts of toner replenishers 225 based on the detection results detected by toner density detectors 224.

Liquid level detectors 226 each are an ON/OFF sensor including a light emitter and a photodetector, for example, and detects the liquid level of the developer in developer housing 220. For example, liquid level detector 226 outputs "ON" when the liquid level of the developer is raised to such a height as to be in the detection range of liquid level detector 226. In addition, liquid level detector 226 outputs "OFF" when the liquid level of the developer is lowered so as to be out of the detection range of liquid level detector 226. Liquid level detector 226 may also be a toner density detector based on the magnetic permeability.

The liquid level of the developer is comparatively high when the charging property of the toner can attain a charge amount greater than a target charge amount (for example, 40 μC/g). This is because, when the charging property of the toner is good, toner particles repel each other, the bulk density of the developer is lowered, and as a result, the liquid level of the developer is easily raised.

The liquid level of the developer is comparatively low when the charging property of the toner attains a charge amount less than the target charge amount. This is because, when the charging property of the toner is poor, toner particles do not repel each other, the bulk density of the developer is increased, and as a result, the liquid level of the developer is easily lowered.

Developer discharging section 230 is a part configured to discharge the developer in developer housing 220, and is provided at a portion of developer housing 220 corresponding to second region 221B. Developer discharging section 230 includes passageway 231, screw member 232, and discharging part 233.

Passageway 231 is a part bringing developer housing 220 and discharging part 233 in communication with each other. Screw member 232 is disposed in passageway 231 and is coaxial with first stirring member 222. Screw member 232 rotates to generate a flow causing the developer to move from passageway 231 toward the inside of developer housing 220. Screw member 232 prevents the developer in developer housing 220 from entering passageway 231.

When the carrier in the developer in developer housing 220 is deteriorated, for example, a carrier replenisher, which is not illustrated, supplies carrier to developer housing 220. Then, when the amount of the developer exceeds the amount of developer that can be stored in developer housing 220, the developer moves to passageway 231 from developer housing 220 and is discharged from discharging part 233.

Figure 6:
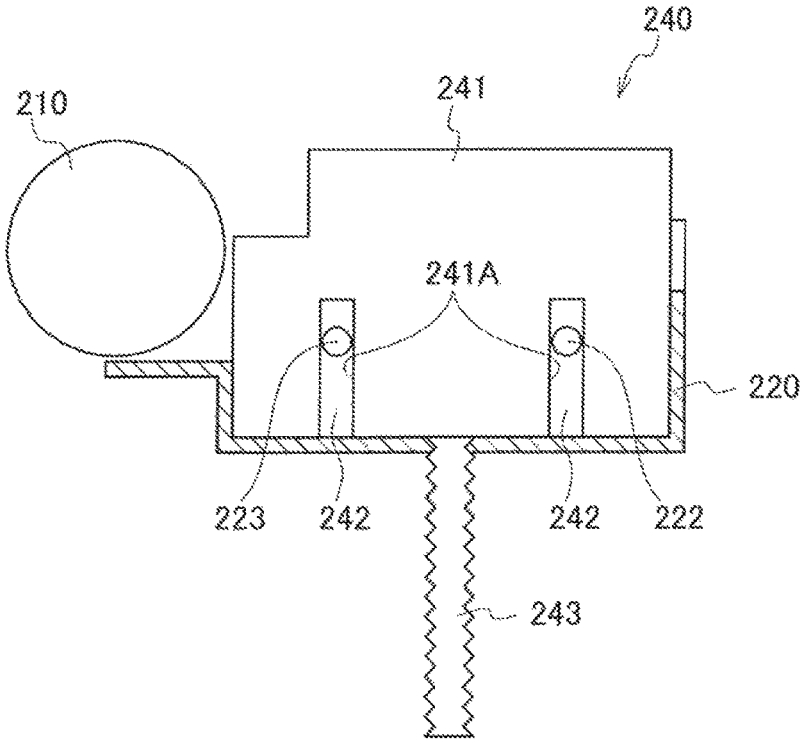
FIG. 6 is a view in which the openable/closable section is in the closed state.
Figure 7:
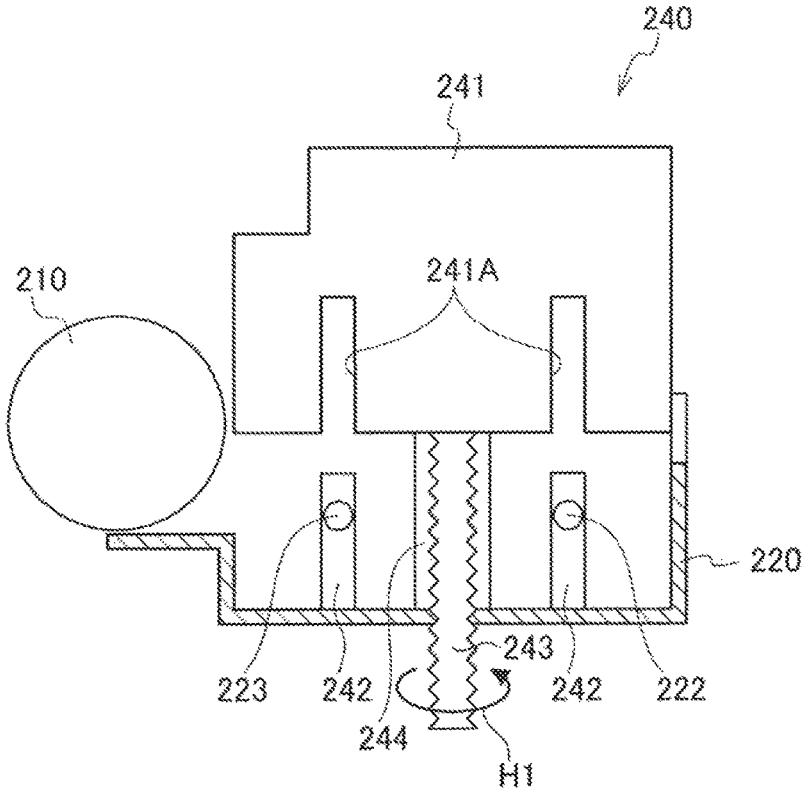
FIG. 7 illustrates a movement of the openable/closable section.
Figure 8:
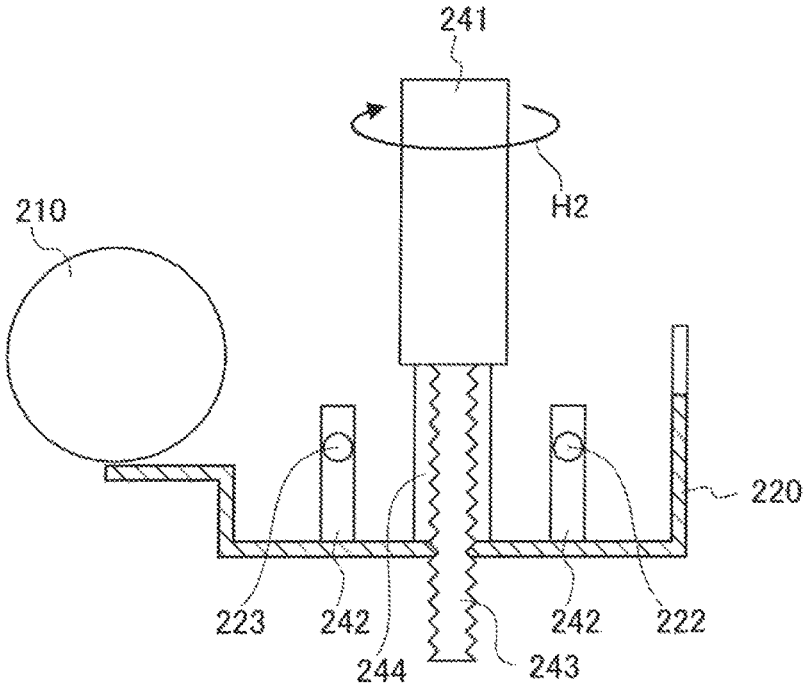
FIG. 8 illustrates a movement of the openable/closable section.
Figure 9:
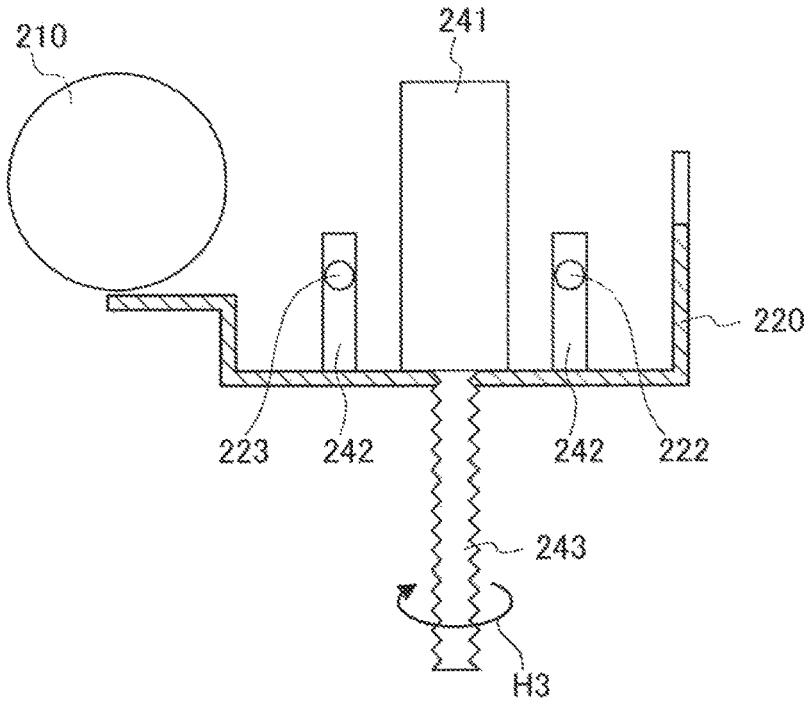
FIG. 9 illustrates the opened state of the openable/closable section.

Next, openable/closable section 240 is described. FIG. 6 illustrates openable/closable section 240 in a closed state. FIG. 7 illustrates a movement of openable/closable section 240. FIG. 8 illustrates a movement of openable/closable section 240. FIG. 9 illustrates openable/closable section 240 in an opened state.

Openable/closable section 240 is configured to enable opening and closing of first and second regions 221A and 221B, and includes movable member 241 and bearing members 242.

Movable member 241 is composed of a platelike member and is formed to have a width sufficient to enable closing of first and second regions 221A and 221B (also see FIG. 6). By transmitting an external driven movement to movable member 241, movable member 241 moves between a position in the closed state where first and second regions 221A and 221B are closed (position of FIG. 4) and a position in the opened state where first and second regions 221A and 221B are opened (position of FIG. 5). The closed state corresponds to a "non-communicated state" of the present invention, and the opened state corresponds to a "communicated state" of the present invention.

Movable member 241 interrupts the movement of the developer between first and second regions 221A and 221B when located at the position of the closed state (see FIG. 4). Movable member 241 is located between and linearly aligned with diaphragms 227 in first and second regions 221A and 221B when located at the position of the opened state (see FIG. 5). Accordingly, together with diaphragms 227, movable member 241 which is located in the position of the opened state partitions each of first and second regions 221A and 221B into the regions corresponding to first and second stirring members 222 and 223.

As illustrated in FIG. 6, bearing members 242 are portions bearing shafts of first and second stirring members 222 and 223, and protrude from the lower wall of developer housing 220 and at positions respectively corresponding to first and second stirring members 222 and 223.

In addition, engaging portion 241A which can be engaged with bearing members 242 is formed at the lower end of movable member 241. Bearing members 242 are engaged with engaging portion 241A of movable member 241, so that first and second regions 221A and 221B are closed by movable member 241 and bearing members 242 when movable member 241 is in the closing position.

In addition, shaft 243 for moving movable member 241 up and down is provided at the lower end of movable member 241. Shaft 243 extends downward from the lower end of movable member 241 and penetrates the bottom of developer housing 220. The surface of shaft 243 is spirally grooved.

As illustrated in FIG. 7, engaging member 244 which engages with the groove in shaft 243 is provided to the bottom of developer housing 220 at a position corresponding to shaft 243. Engaging member 244 extends upward from the bottom of developer housing 220, and is located inside of movable member 241 when movable member 241 is located lowermost. Movable member 241 moves upward with the spiral groove when shaft 243 rotates in the direction of arrow H1.

In addition, movable member 241 is formed such that movable member 241 rotates independently from shaft 243, and thus moves up and down without being affected by rotation of shaft 243 during rotation of shaft 243. As illustrated in FIG. 8, movable member 241 rotates 90 degrees in the direction of arrow H2 by control of control section 100 after movable member 241 has arrived at the uppermost position. In this way, it is possible to change the direction of movable member 241 into the directions corresponding to the position of the opened state and the position of the closed state.

Then, as illustrated in FIG. 9, movable member 241 moves downward with the spiral groove when shaft 243 rotates in the direction of arrow H3 after the orientation of movable member 241 is changed. Accordingly, movable member 241 can be moved to the position of the opened state from the position of the closed state.

In addition, first and second stirring members 222 and 223 stated above can rotate independently from each other in each of first and second regions 221A and 221B. Control section 100 controls the rotation directions of first stirring member 222A and second stirring member 223A in first region 221A, and of first stirring member 222B and second stirring member 223B in second region 221B depending on the position of movable member 241.

Here, the rotation directions of first and second stirring members 222 and 223 in the case where movable member 241 is in the position of the closed state are described.

As illustrated in FIG. 4, control section 100 controls the rotation directions of first stirring member 222 in first and second regions 221A and 221B such that the developer moves in first and second regions 221A and 221B from the inside toward the outside in the axial direction of developing sleeve 210 when movable member 241 is in the position of the closed state.

Control section 100 controls the rotation directions of second stirring member 223 in first and second regions 221A and 221B such that the developer moves in first and second regions 221A and 221B from the outside toward the inside in the axial direction of developing sleeve 210 when movable member 241 is in the position of the closed state.

Thus, when movable member 241 is in the position of the closed state, the developer moves in the directions of arrows X1 and X2 in first and second regions 221A and 221B by rotation of first and second stirring members 222 and 223.

That is, the developer circulation state in developer housing 220 is set to the first state in which respective developer circulation paths are formed in first and second regions 221A and 221B. To be specific, the circulation direction (arrow X1) of the developer in first region 221A created by first stirring member 222A and second stirring member 223A and the circulation direction (arrow X2) of the developer in second region 221B created by first stirring member 222B and second stirring member 223B are controlled to differ from each other when the developer circulation state is the first state.

Next, the rotation directions of first and second stirring members 222 and 223 in the case where movable member 241 is in the position of the opened state are described.

As illustrated in FIG. 5, when movable member 241 is in the position of the opened state, control section 100 controls the rotation directions of first stirring member 222 such that the developer moves in the same direction in a region of first and second regions 221A and 221B corresponding to first stirring member 222. In the example illustrated in FIG. 5, the rotation directions of first stirring member 222 are controlled such that the developer moves in the direction from the left side toward the right side. That is, the rotation direction of first stirring member 222A in first region 221A is changed between the first state and the second state.

Thus, when movable member 241 is in the position of the opened state, the developer moves in the direction of arrow X3 in first and second regions 221A and 221B by rotation of first and second stirring members 222 and 223.

That is, the developer circulation state in developer housing 220 is set to the second state in which a single developer circulation path is formed in entire first and second regions 221A and 221B. To be specific, when the developer circulation state is the second state, an annular developer circulation path (arrow X3) is formed in entire first and second regions 221A and 221B.

In the meantime, the rotation directions of first and second stirring members 222B and 223B in second region 221B may be changed between the first and the second states in order that the developer can move in the direction opposite to the direction of arrow X3.

Figure 10A:
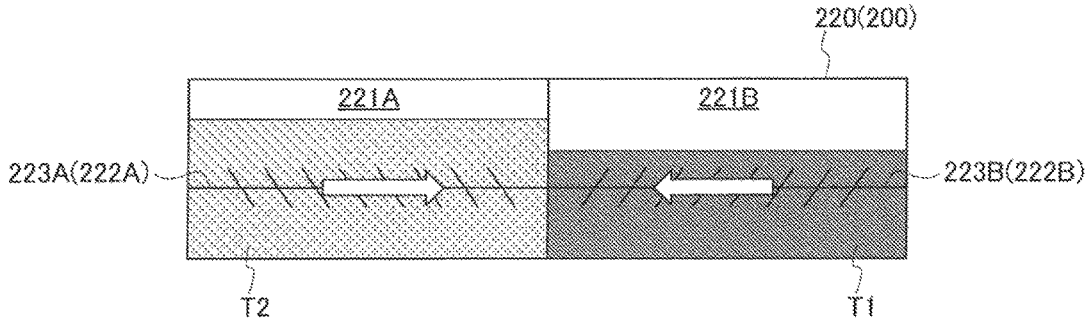
FIG. 10A is a simplified view illustrating a state of the developer in a developer housing.

In the meantime, in a case where a difference arises between the bulk densities of the developer in first and second regions 221A and 221B in developer housing 220 during the first state of the developer circulation state as illustrated in FIG. 10A, it is difficult for the developer to be moved to the next region when first and second regions 221A and 221B are opened since there is no mechanism to pass the developer to the next region. Accordingly, it takes time for all the developer in first and second regions 221A and 221B to be mixed uniformly.

In addition, in a case where a difference arises between the bulk densities of the developer in first and second regions 221A and 221B, it may also be possible that only developer T1 having a higher bulk density flows into a region in which developer T2 having a lower bulk density is present, and the developer is thereby two-layered in the region in which the developer having a lower bulk density is present (first region 221A in FIG. 10A).

Accordingly, in the present embodiment, control section 100 performs control to switch between the first and the second states depending on the state of the developer in first and second regions 221A and 221B. By changing the developer circulation state from the first state into the second state, developer T2 in first region 221A and developer T1 in second region 221B can flow along the same developer circulation path. This makes it easy for the developer in entire first and second regions 221A and 221B to be mixed uniformly, and can prevent the developer in one region from being two-layered.

The rotation directions of first and second stirring members 222 and 223 may be arbitrarily set depending on embodiments.

Figure 10B:
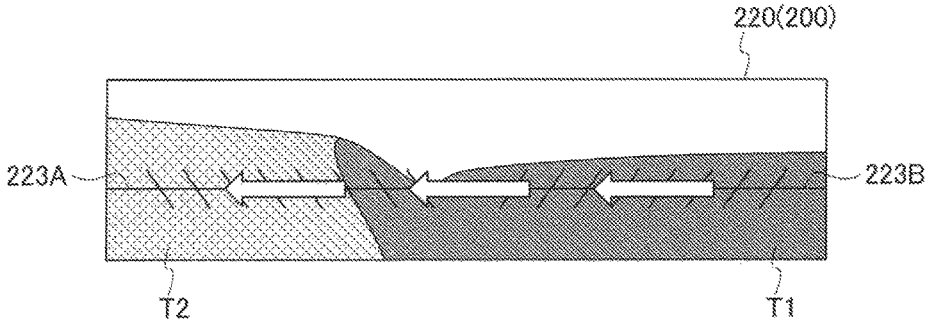
FIG. 10B is a simplified view illustrating a state of the developer in the developer housing.

For example, in a case where the developer is circulated from the side of developer T1 having a higher bulk density to the side of developer T2 having a lower bulk density as illustrated in FIG. 10B, developer T2 having a lower bulk density flows ahead of developer T1 having a higher bulk density since developer T2 has a better fluidity. Accordingly, it is possible to prevent the developer from being two-layered.

Figure 10C:
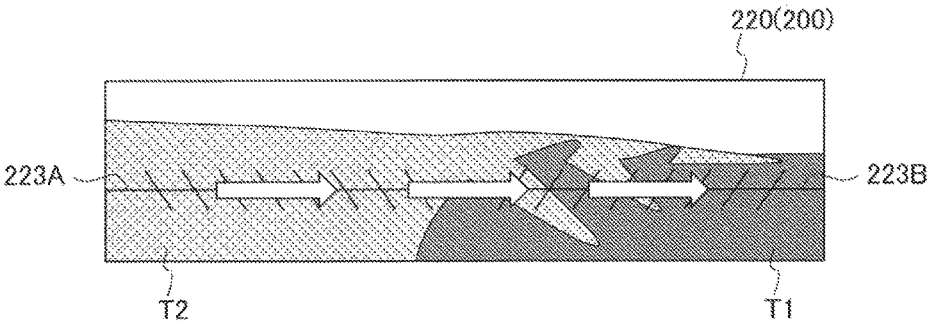
FIG. 10C is a simplified view illustrating a state of the developer in the developer housing.

In addition, in a case where the developer is circulated from the side of developer T2 having a lower bulk density to the side of developer T1 having a higher bulk density as illustrated in FIG. 10C, developer T2 having a lower bulk density moves onto developer T1 having a higher bulk density since developer T2 has a higher liquid level and a better fluidity than that of developer T1. Then, the developer is stirred promptly by first stirring member 222 or second stirring member 223, so that it is possible to prevent the developer from being two-layered.

Next, the control of when the developer circulation state is changed from the first state to the second state is described.

Figure 12:
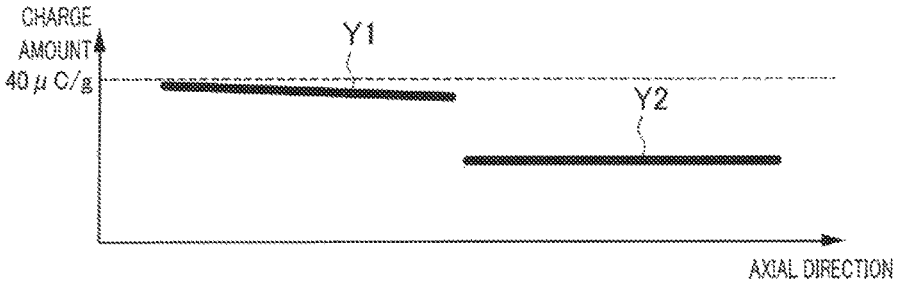
FIG. 12 illustrates the charge amount of toner in the developer housing in the axial direction.

In the first state of the developer circulation state, for example, in a case where toner images T are consecutively formed in which the amount of toner in portion S1 of the toner image corresponding to first region 221A is extremely greater than that of toner in portion S2 of the toner image corresponding to second region 221B, fresh toner is replenished in first region 221A, so that the charge amount of toner is maintained at a value near the target charge amount (for example, 40 μC/g) in first region 221A as illustrated in FIG. 12 (see solid line Y1).

In contrast, there is no toner consumption in second region 221B, so that the amount of toner remaining in second region 221B without being discharged from developer housing 220 increases, and thus deterioration of the developer is caused. Accordingly, toner-spent, deterioration of additives, lubricant transfer, and the like occur in the developer in second region 221B, so that a significant decrease in the charge amount of toner is caused (see solid line Y2).

If a difference between the charge amounts of toner in first and second regions 221A and 221B arises, and when, for example, a halftone image is printed, a conspicuous difference in density is caused between first and second regions 221A and 221B, and this density difference constitutes a defect in the image quality. A major factor of a decrease in the charge amount of toner is deterioration of the carrier. Accordingly, states of the carrier in first and second regions 221A and 221B needs to be equalized in order to equalize the charge amounts of toner in first and second regions 221A and 221B.

Thus, in the present embodiment, control section 100 determines, in the case of the first state of the developer circulation state, whether or not the developer circulation state should be changed from the first state to the second state depending on a difference between liquid levels in first and second regions 221A and 221B detected by liquid level detectors 226.

To be specific, control section 100 changes the developer circulation state from the first state into the second state when the difference between liquid levels in first and second regions 221A and 221B is greater than a first threshold (for example, 10 mm). First and second regions 221A and 221B are thus opened and the developer is mixed up in entire developer housing 220, and this leads to equalization of the states of the carrier, that is, the states of the developer, and thus to equalization of the charge amount of toner. In this way, a difference in the charge amount of toner between first and second regions 221A and 221B does not easily arise, and therefore, it is possible to efficiently equalize the states of the developer and thus to stabilize the image quality.

Next, the control of when the developer circulation state is changed from the second state to the first state is described.

Figure 11:
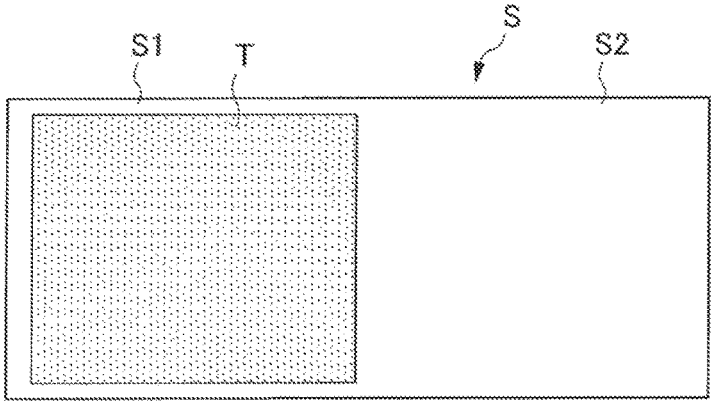
FIG. 11 illustrates a sheet on which a toner image is formed whose portions corresponding to the first and the second regions are largely different in coverage.

When toner images T as illustrated in FIG. 11 are consecutively formed during the second state of the developer circulation state, a problem arises in that the toner density in the portion corresponding to first region 221A decreases.

Figure 13:
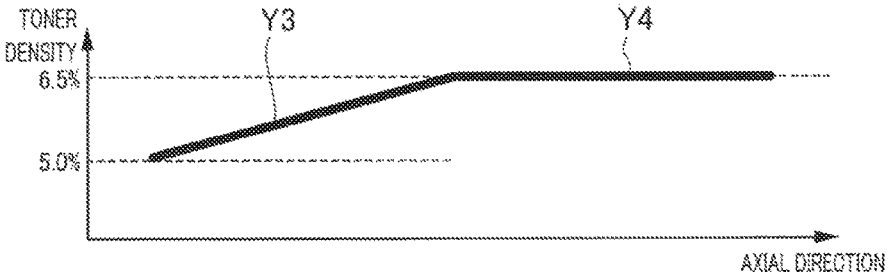
FIG. 13 illustrates the toner density in the developer housing in the axial direction.

In particular, when toner images T illustrated in FIG. 11 are consecutively formed, only the amount of toner consumption in first region 221A increases extremely. Accordingly, as illustrated in FIG. 13, the toner density in first region 221A decreases with increasing distance from the position of toner replenisher 225 in the axial direction, that is, from the left end toward the middle in the axial direction (see solid line Y3). In contrast, the toner density in second region 221B is substantially constant at the target density (for example, 6.5%) (see solid line Y4).

In this way, in the case where first and second regions 221A and 221B are opened, formation of images in which the toner amount is concentrated on one side in the axial direction causes an increase in deviations in the toner density in the axial direction.

Thus, in the present embodiment, control section 100 determines, in the case of the second state of the developer circulation state, whether or not the developer circulation state should be changed from the second state to the first state depending on a difference between toner densities in first and second regions 221A and 221B detected by toner density detectors 224.

In particular, control section 100 changes the developer circulation state from the second state into the first state when the difference between toner densities in first and second regions 221A and 221B is greater than a second threshold (for example, 0.5%). Then, when the developer circulation state is changed from the second state into the first state, control section 100 controls toner replenishers 225 to increase the amount of toner to be replenished to one region of first and second regions 221A and 221B in which the amount of toner consumption is greater, that is, in which the toner density is smaller.

For example, in the example illustrated in FIG. 13, the toner density has extremely decreased only in first region 221A, and accordingly a toner density of 5% is detected at the position of toner density detector 224. In contrast, little toner is consumed in second region 221B, and thus, the toner density in second region 221B is substantially constant in the axial direction at the target density. Accordingly, the difference between the toner densities in first and second regions 221A and 221B is 1.5%, which is greater than the second threshold.

Figure 14:
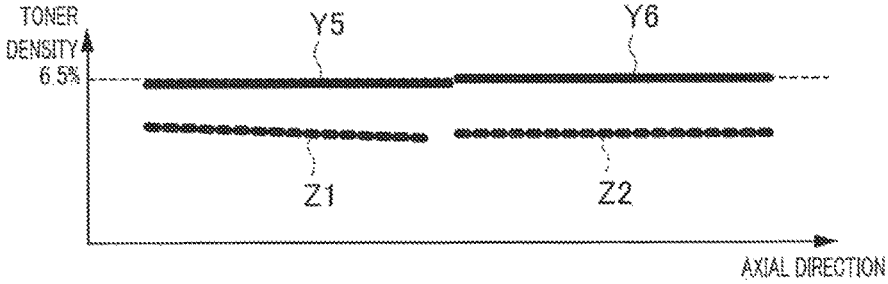
FIG. 14 illustrates the toner density in the developer housing in the axial direction.

In this case, control section 100 changes the developer circulation state into the first state and toner is replenished to first region 221A. In this manner, the states of the developer in first and second regions 221A and 221B can be equalized promptly and efficiently as illustrated in FIG. 14 (see solid lines Y5 and Y6), and accordingly, the image quality along the entire axial direction of developing device 200 can be stabilized.

In the meanwhile, in a configuration in which first and second regions 221A and 221B are opened, the developer in first and second regions 221A and 221B is mixed after the lapse of time. Accordingly, the decrease in the toner density in first region 221A causes a decrease in toner density in the entire regions (see dashed lines Z1 and Z2). In contrast, in the present embodiment, first and second regions 221A and 221B are closed, so that it is possible to prevent a decrease in toner density in the entire regions caused by a decrease in toner density in any of first and second regions 221A and 221B.

In addition, control section 100 stops the movements of first and second stirring members 222 and 223 during switching the developer circulation state between the first and the second states.

Figure 15A:
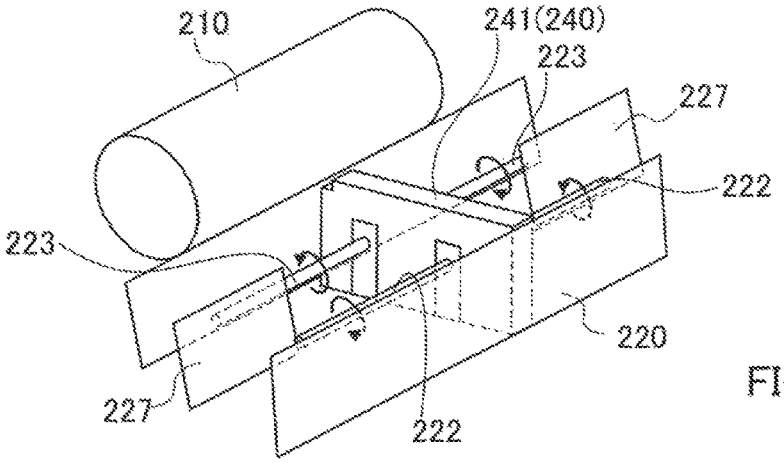
FIG. 15A is a simplified perspective view of a portion of the openable/closable section in the developer housing.
Figure 15B:
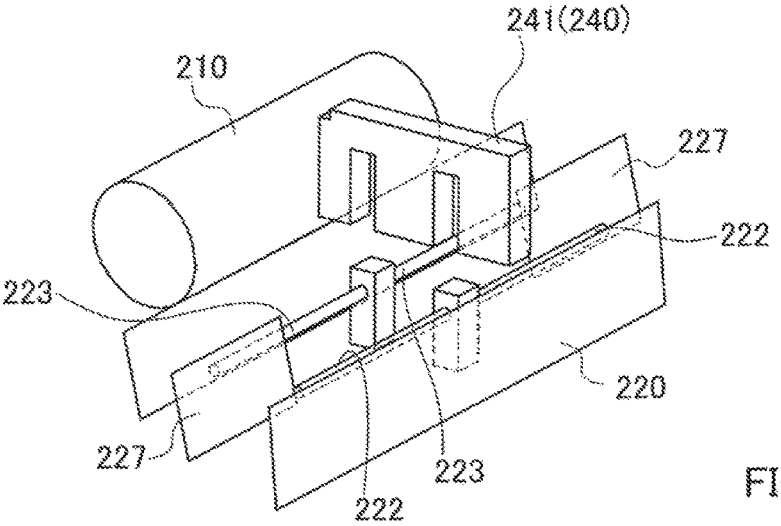
FIG. 15B is a simplified perspective view of the portion of the openable/closable section in the developer housing.

To be specific, first and second stirring members 222 and 223 rotate in the rotation directions indicated by arrows in respective regions during the first state of the developer circulation state (see FIG. 15A), but rotations of first and second stirring members 222 and 223 are stopped when movable member 241 is moved (see FIG. 15B). This is because the developer in each region may flow into unexpected parts of developer housing 220 if first and second stirring members 222 and 223 are left rotated when movable member 241 is moved upward.

Figure 15C:
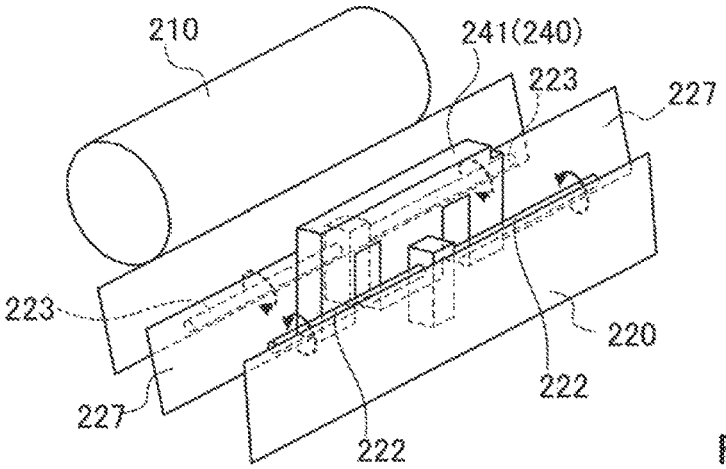
FIG. 15C is a simplified perspective view of the portion of the openable/closable section in the developer housing.

Then, after movable member 241 is rotated, movable member 241 is lowered and first and second stirring members 222 and 223 are operated (see FIG. 15C).

In the meantime, control section 100 may control the rotational frequencies of first and second stirring members 222 and 223, that is, their rotational speeds. In particular, control section 100 may set different rotational speeds between first and second stirring members 222A and 223A in first region 221A on one hand, and first and second stirring members 222B and 223B in second region 221B on the other hand.

For example, control section 100 controls such that first and second stirring members 222 and 223 in one region of first and second regions 221A and 221B where the liquid level of the developer is higher, that is, where the charge amount of toner is greater have faster rotational speeds than first and second stirring members 222 and 223 in the other region where the liquid level of the developer is lower, that is, where the charge amount of toner is smaller.

This makes it possible to promptly move the developer in the region where the liquid level of the developer is higher, toward the region where the liquid level of the developer is lower. As a result, the charge amount of toner can be promptly equalized.

In addition, control section 100 may control to switch the developer circulation state between the first and the second states depending on a difference between the amount of developer supplied from first region 221A to developing sleeve 210, and the amount of developer supplied from second region 221B to developing sleeve 210. That is, control section 100 may determine whether or not to control to switch the developer circulation state depending on a difference between the coverage of the toner image corresponding to first region 221A of developer housing 220, and the coverage of the toner image corresponding to second region 221B of developer housing 220.

To be specific, control section 100 controls to switch the developer circulation state when the difference in coverage is greater than 50%. When the amounts of toner consumption are different between first and second regions 221A and 221B, a difference is easily caused between the states of the developer in first and second regions 221A and 221B. Efficient control is thus possible since control is performed only when necessary by determining whether or not to control to switch the developer circulation state depending on the difference in coverage.

In addition, when the developer circulation state is changed into the second state as described below, it is desirable that control section 100 controls first and second stirring members 222 and 223 such that the developer flows toward developer discharging section 230. It is thus made easier for deteriorated developer to move along the flow of the developer circulation path in the second state toward developer discharging section 230, so that the deteriorated developer can be efficiently discharged from developer housing 220.

Figure 16:
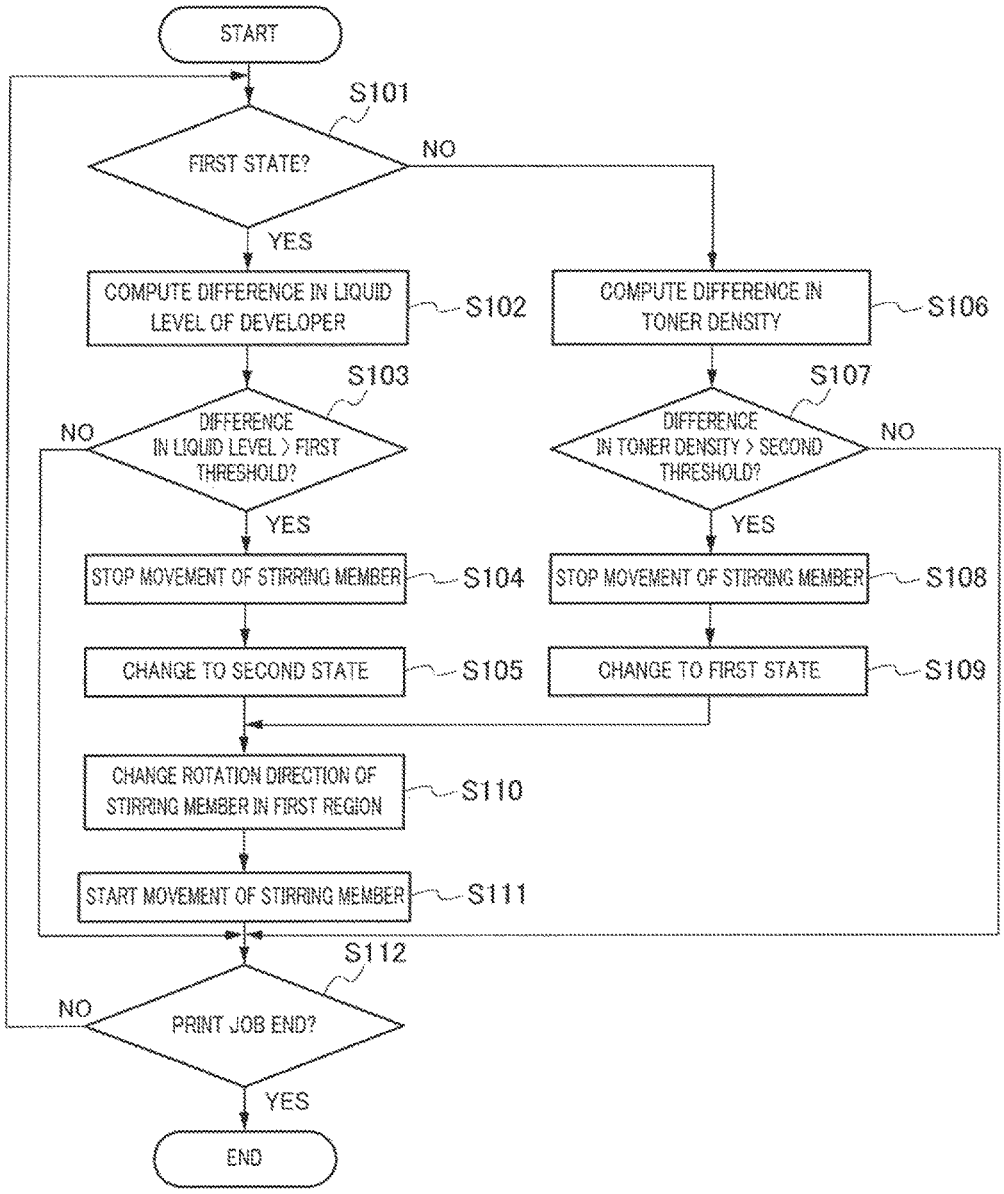
FIG. 16 is a flow chart illustrating an exemplary operation of a developer-circulation-state switching control in the image forming apparatus.

Next, an exemplary operation of the developer-circulation-state switching control in image forming apparatus 1 is described. FIG. 16 is a flow chart illustrating the exemplary operation of the developer-circulation-state switching control in image forming apparatus 1. The processes in FIG. 16 are appropriately performed in a printing job.

As illustrated in FIG. 16, control section 100 determines whether or not the developer circulation state is the first state (step S101). When the determination result indicates that the developer circulation state is the first state (step S101, YES), a difference between the liquid levels of the developer in first and second regions 221A and 221B is computed (step S102).

Next, control section 100 determines whether or not the difference between the liquid levels of the developer is greater than the first threshold (step S103). When the determination result indicates that the difference between the liquid levels of the developer is equal to or less than the first threshold (step S103, NO), the process proceeds to step S112. In the meanwhile, when the difference between the liquid levels of the developer is greater than the first threshold (step S103, YES), control section 100 stops the movements of first and second stirring members 222 and 223 (step S104).

Next, control section 100 changes the developer circulation state from the first state into the second state (step S105). Then, the process proceeds to step S110.

Reference is made back to determination at step S101. When the developer circulation state is the second state (step S101, NO), a difference between the toner densities in first and second regions 221A and 221B is computed (step S106).

Next, control section 100 determines whether or not the difference between the toner densities is greater than the second threshold (step S107). When the determination result indicates that the difference between the toner densities is equal to or less than the second threshold (step S107, NO), the process proceeds to step S112. In the meanwhile, when the difference between the toner densities is greater than the second threshold (step S107, YES), control section 100 stops the movements of first and second stirring members 222 and 223 (step S108).

Next, control section 100 changes the developer circulation state from the second state into the first state (step S109). Control section 100 changes the rotation directions of first and second stirring members 222A and 223A in first region 221A after step S105 and step S109 (step S110). Alternatively, in step S110, control section 100 may control to change the rotation directions of first and second stirring members 222B and 223B in second region 221B.

Next, control section 100 starts the movements of first and second stirring members 222 and 223 (step S111). Next, control section 100 determines whether or not the printing job has been completed (step S112). When the determination result indicates that the printing job has not been completed (step S112, NO), the process returns to step S101, and when the printing job has been completed (step S112, YES), control section 100 ends the present control.

According to the present embodiment configured as described above, the developer circulation state is controlled depending on the states of the developer in first and second regions 221A and 221B, so that the state of the developer along the entire axial direction of developing device 200 can be efficiently equalized.

In addition, the developer can be actively moved to the next region by changing the developer circulation state into the second state from the first state, so that the state of the developer in the entire axial direction of developing device 200 can be promptly equalized.

Next, modification 1 is described.

Figure 17A:
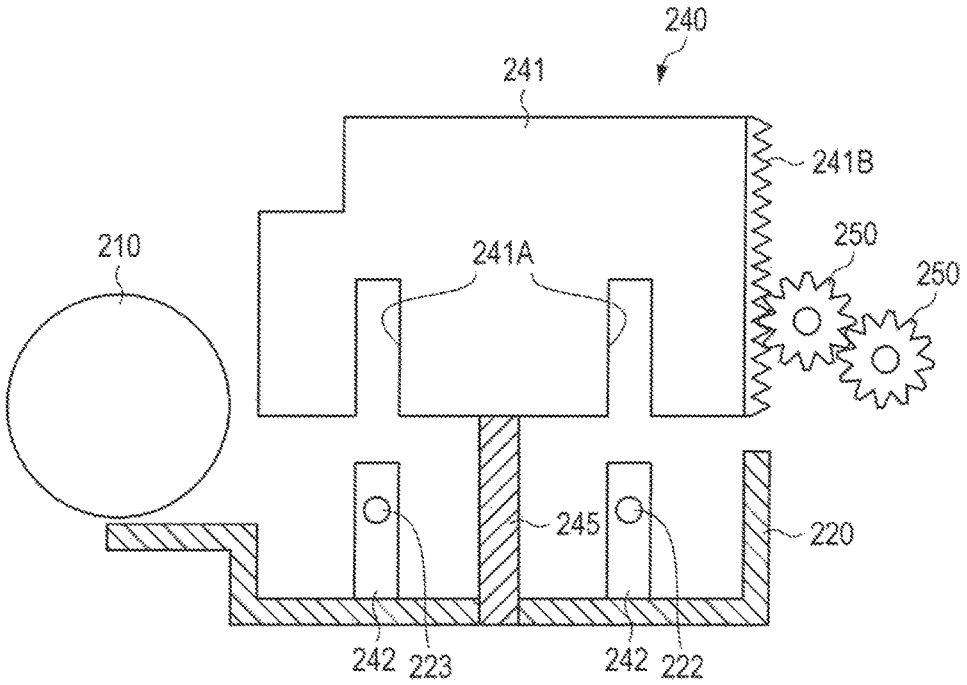
FIG. 17A illustrates an openable/closable section according to modification 1.
Figure 17B:
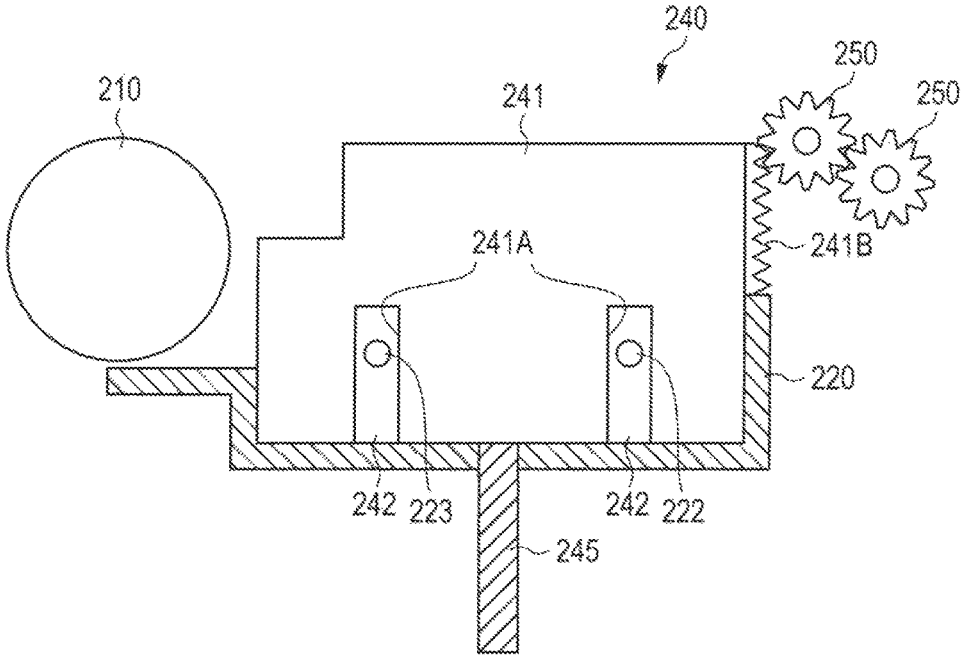
FIG. 17B illustrates the openable/closable section according to modification 1.

As illustrated in FIGS. 17A and 17B, movable member 241 according to modification 1 is not provided with shaft 243 such as that of the above-mentioned embodiment, and is provided with gear teeth 241B which is put into gear with a part of transmission gear 250 by which an external driving movement is transmitted. Movable member 241 moves up and down by rotation of transmission gears 250. Movable member 241 is located uppermost when the developer circulation state is in the position of the second state (see FIG. 17A), and is located lowermost when the developer circulation state is in the position of the first state (see FIG. 17B).

In addition, diaphragm member 245 is provided at the lower end of movable member 241 according to modification 1. Diaphragm member 245 is a member serving as a partition between the region in which first stirring member 222 is provided and the region in which second stirring member 223 is provided.

Figure 18A:
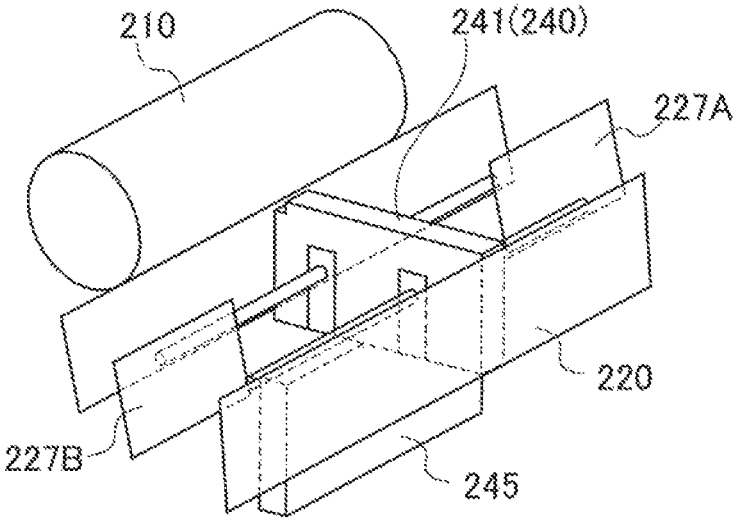
FIG. 18A is a simplified perspective view of a portion of the openable/closable section in a developer housing according to modification 1.
Figure 18B:
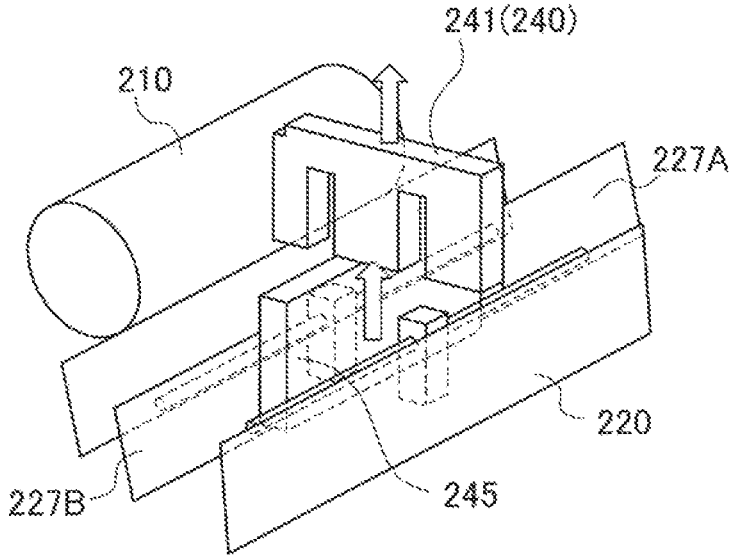
FIG. 18B is a simplified perspective view of the portion of the openable/closable section in the developer housing according to modification 1.

Diaphragm member 245 is located at a position corresponding to a position between diaphragm 227A in first region 221A and diaphragm 227B in second region 221B (see FIG. 18A). When the developer circulation state is the second state, diaphragm member 245 is then located between and linearly aligned with diaphragms 227A and 227B in developer housing 220 (see FIG. 18B), to thereby completely partition each of first and second regions 221A and 221B into the regions of first and second stirring members 222 and 223.

With such a configuration, in contrast to the above-described embodiment, there is no operation in which movable member 241 is rotated 90 degrees when the developer circulation state is switched between the first and the second states, so that the developer-circulation-state switching control can be simplified.

Next, modification 2 is described.

Figure 19A:
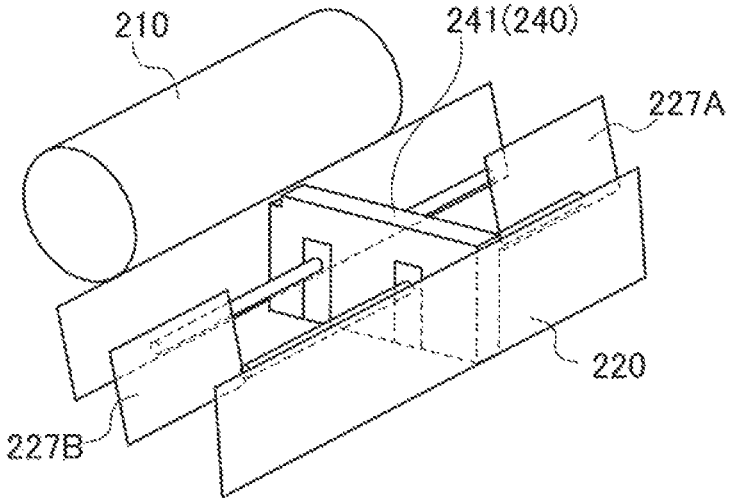
FIG. 19A is a simplified perspective view of a portion of an openable/closable section in a developer housing according to modification 2.
Figure 19B:
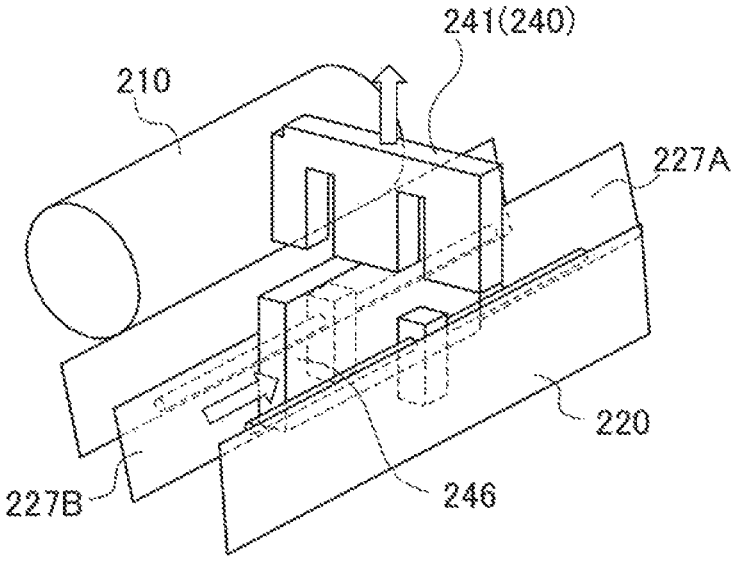
FIG. 19B is a simplified perspective view of the portion of the openable/closable section in the developer housing according to modification 2.

Movable member 241 and diaphragm member 245 are integrally formed in modification 1, whereas movable member 241 and diaphragm member 246 are separately formed in modification 2 as illustrated in FIGS. 19A and 19B.

Diaphragm member 246 is retracted, for example, to the position of diaphragm 227B in developer housing 220 when the developer circulation state is the first state. When the developer circulation state is the second state, diaphragm member 246 is slid in the axial direction from the position of diaphragm 227B during the upward movement of movable member 241 and comes to the position between diaphragms 227A and 227B. In this way, the regions of first and second stirring members 222 and 223 are completely separated from each other. It is to be noted that illustration of diaphragm member 246 is omitted in FIG. 19A.

Also with such a configuration, there is no operation in which movable member 241 is rotated 90 degrees in contrast to the above-described embodiment, so that the developer-circulation-state switching control can be simplified.

Next, modification 3 is described.

Figure 20A:
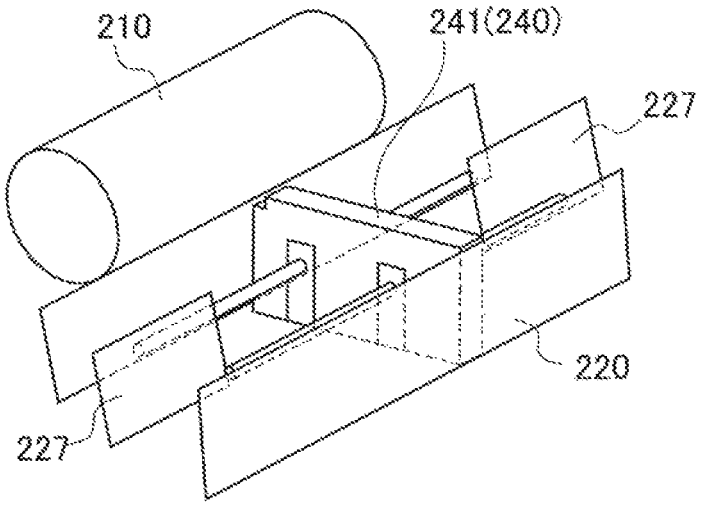
FIG. 20A is a simplified perspective view of a portion of an openable/closable section in a developer housing according to modification 3.
Figure 20B:
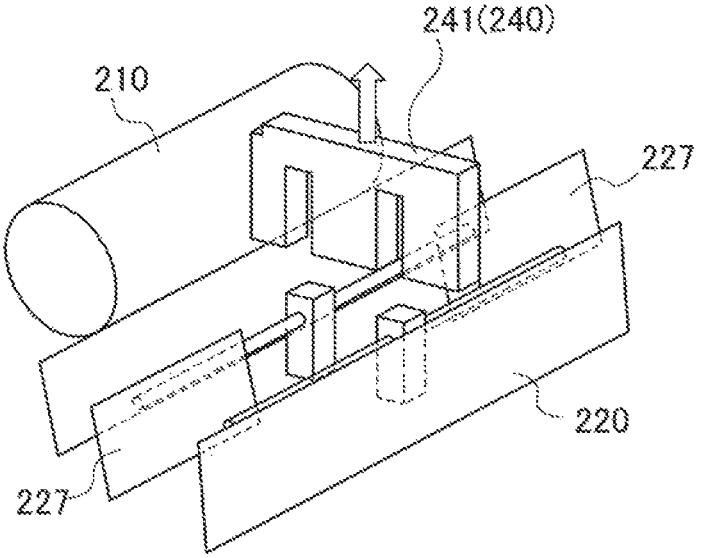
FIG. 20B is a simplified perspective view of the portion of the openable/closable section in the developer housing according to modification 3.

Diaphragm members 245 and 246 are provided respectively in modifications 1 and 2, whereas a configuration may be adopted in which, as illustrated in FIGS. 20A and 20B, diaphragm members 245 and 246 are not provided. That is, movable member 241 moves between the closing position (see FIG. 20A) in which first and second regions 221A and 221B are closed, and the opening position (see FIG. 20B) in which movable member 241 is retracted above the closing position. With this modification, a simpler configuration can be obtained.

Next, modification 4 is described.

Figure 21:
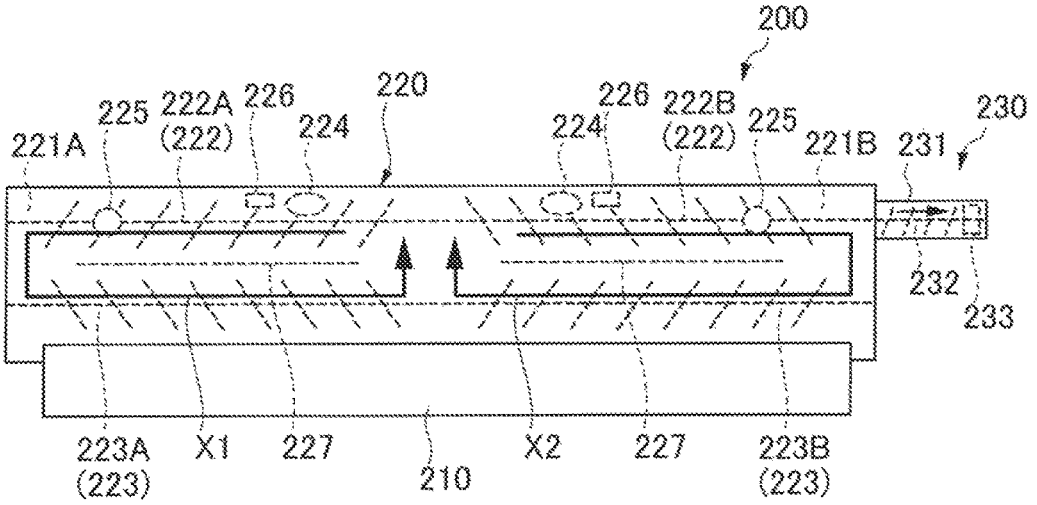
FIG. 21 illustrates a developing device according to modification 4 as seen from above.
Figure 22:
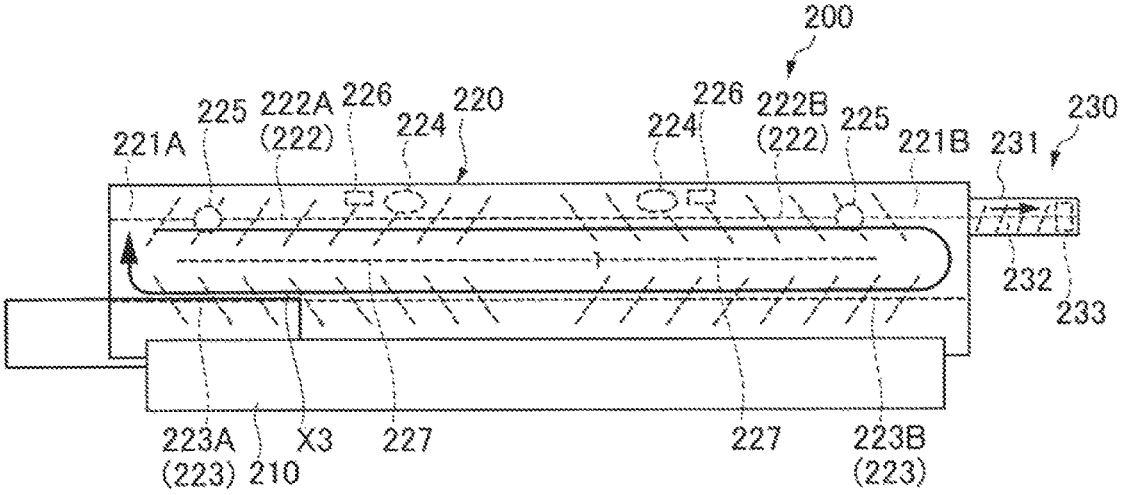
FIG. 22 illustrates the developing device according to modification 4 as seen from above.

Although movable member 241 is provided in the above-mentioned embodiment, the present invention is not limited to the embodiment and may adopt a configuration in which movable member 241 is not provided as illustrated in FIGS. 21 and 22. That is, first and second regions 221A and 221B are always opened, and only the rotation directions of respective first and second stirring members 222 and 223 in first and second regions 221A and 221B are controlled in modification 4.

To be specific, as illustrated in FIG. 21, the rotation directions of first and second stirring members 222 and 223 are controlled such that the developer moves in the directions of arrows X1 and X2 when the developer circulation state is the first state. In addition, as illustrated in FIG. 22, the rotation directions of first and second stirring members 222 and 223 are controlled such that the developer moves in the direction of arrow X3 when the developer circulation state is the second state.

With such a configuration, control of movement of movable member 241 is not required when the developer circulation state is switched between the first and the second states, so that the developer-circulation-state switching control can be simplified.

Next, modification 5 is described.

Figure 23:
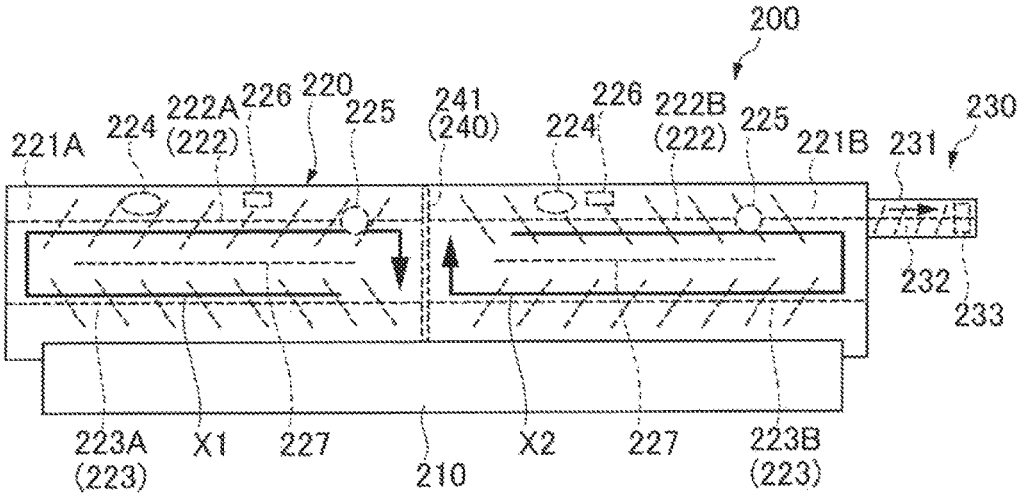
FIG. 23 illustrates a developing device according to modification 5 as seen from above.

In the above-mentioned embodiment, the circulation direction of the developer in first region 221A differs from the circulation direction of the developer in second region 221B when the developer circulation state is the first state. In modification 5, however, as illustrated in FIG. 23, the circulation direction (arrow X1) of the developer circulation path created by first and second stirring members 222A and 223A in first region 221A, and the circulation direction (arrow X2) of the developer circulation path created by first and second stirring members 222B and 223B in second region 221B are the same direction (clockwise direction in the figure).

Figure 24:
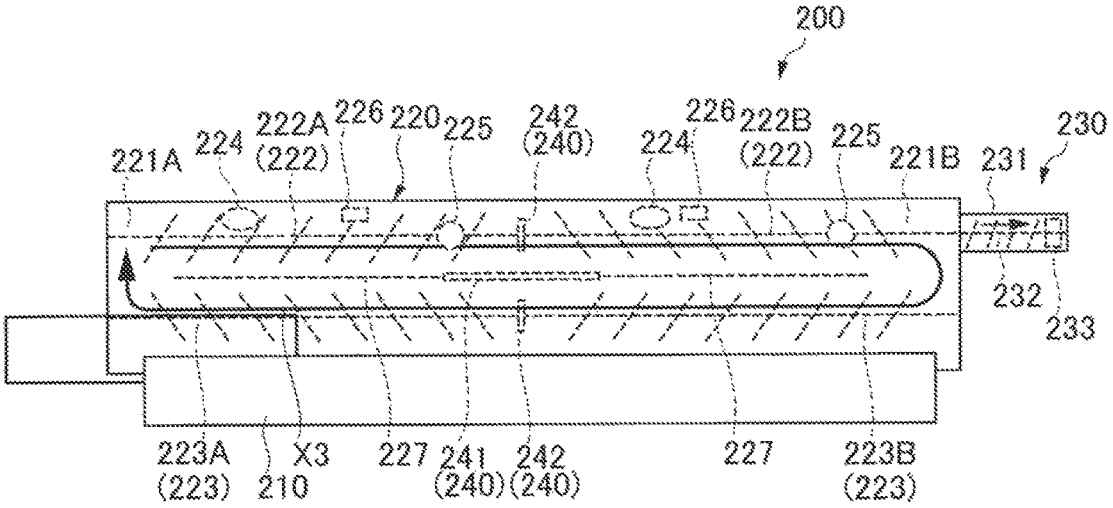
FIG. 24 illustrates the developing device according to modification 5 as seen from above.

Accordingly, as illustrated in FIG. 24, it is unnecessary to control the rotation directions of first and second stirring members 222 and 223 when the developer circulation state is changed into the second state. In particular, in the flow chart in FIG. 16, controls at steps S104, S108, S110, and S111 are not required. That is, stirring movement for stirring the developer in developer housing 220 can be performed smoothly without stopping movements of first and second stirring members 222 and 223 even when movable member 241 is moved.

Figure 25A:
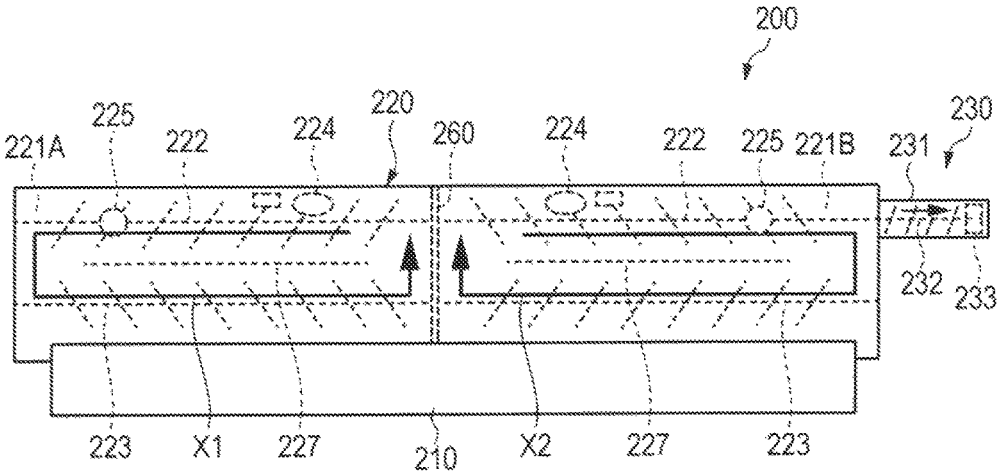
FIG. 25A illustrates a developing device according to modification 6 as seen from above, in which a passage formation section is in a closed state.
Figure 25B:
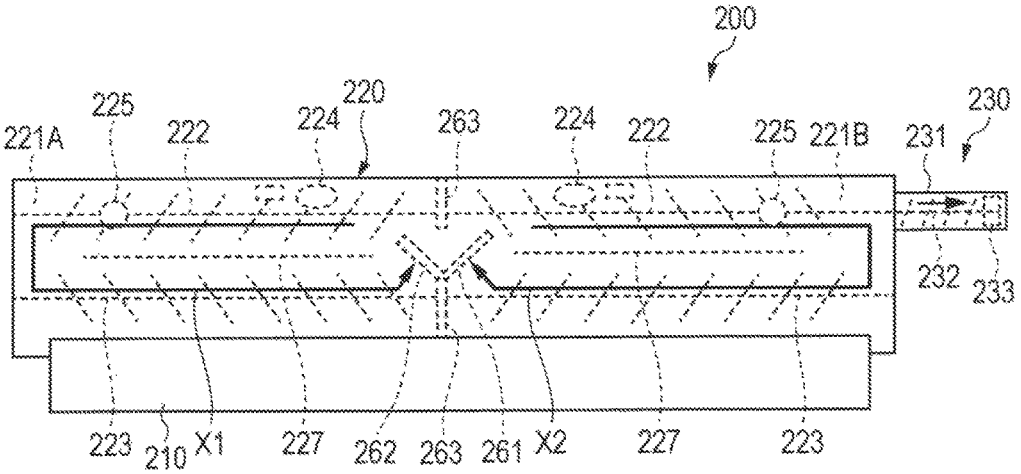
FIG. 25B illustrates the developing device according to modification 6 as seen from above, in which the passage formation section is in an opened state.

Next, modification 6 is described. FIG. 25A illustrates developing device 200 as seen from above, in which passage formation section 260 is in a closed state. FIG. 25B illustrates developing device 200 as seen from above, in which passage formation section 260 is in an opened state.

Figure 26A:
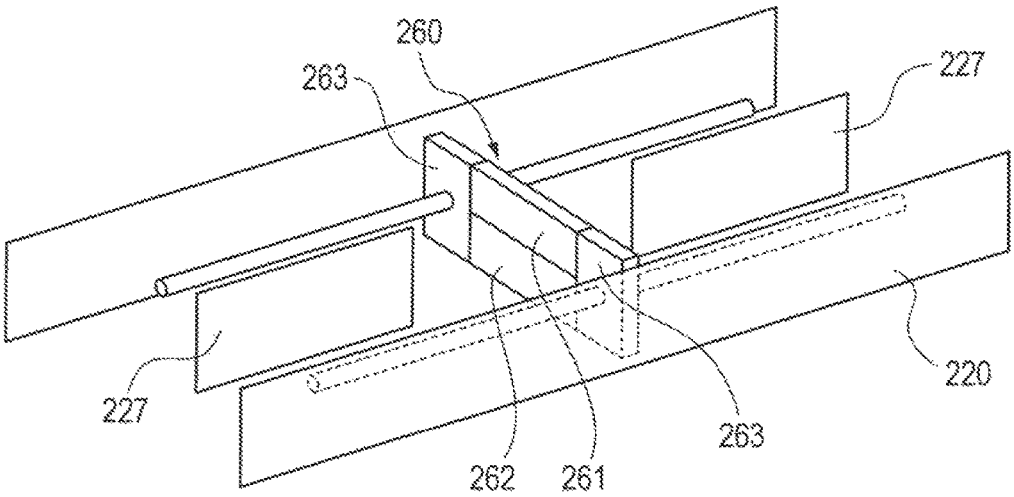
FIG. 26A is a simplified perspective view illustrating the passage formation section in the closed state in the developer housing.
Figure 26B:
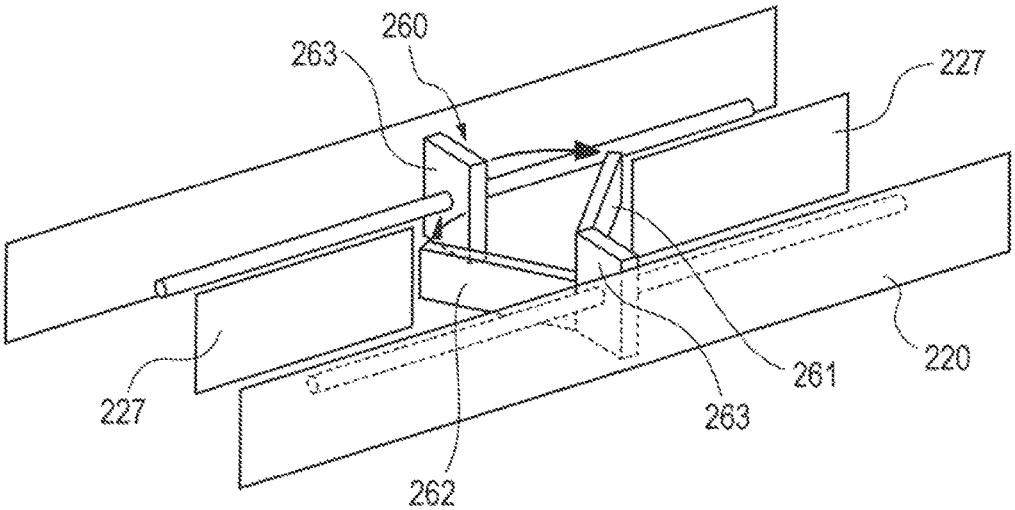
FIG. 26B is a simplified perspective view illustrating the passage formation section in the opened state in the developer housing.

FIG. 26A is a simplified perspective view illustrating passage formation section 260 in the closed state in developer housing 220. FIG. 26B is a simplified perspective view illustrating passage formation section 260 in the opened state in developer housing 220.

As illustrated in FIGS. 25A and 25B, passage formation section 260 located between first and second regions 221A and 221B is provided in developer housing 220 according to modification 6. Passage formation section 260 serves as a partition between first and second regions 221A and 221B.

As illustrated in FIGS. 26A and 26B, passage formation section 260 is located at the boundary between first and second regions 221A and 221B in developer housing 220, and includes first door 261, second door 262, and support members 263. Support members 263 are located at positions corresponding to first and second stirring members 222 and 223, respectively.

First and second doors 261 and 262 are supported in such a manner as to be turnable by support member 263 which supports first stirring member 222. First and second doors 261 and 262 come to be in the closed state in which first and second regions 221A and 221B are closed, when first and second doors 261 and 262 are located in parallel with support member 263 (see FIG. 26A). That is, passage formation section 260 serves as a diaphragm member for separating first region 221A from second region 221B by first door 261, second door 262, and two support members 263, when first and second doors 261 and 262 are in the closed state.

Each of first and second doors 261 and 262 turns on the side of first region 221A or on the side of second region 221B so as to be in the opened state in which first and second regions 221A and 221B are opened (see FIG. 26B).

By opening first door 261, a portion corresponding to first door 261 in the up-and-down direction is defined as the first passage for movement of the developer between first and second regions 221A and 221B. In contrast, closing first door 261 results in a state where the first passage is not formed.

By opening second door 262, a portion corresponding to second door 262 in the up-and-down direction, that is, a portion below first door 261 is defined as the second passage for movement of the developer between first and second regions 221A and 221B. In contrast, closing second door 262 results in a state where the second passage is not formed.

In the meantime, when images are consecutively formed in which the amount of toner in a portion of the image corresponding to first region 221A and the amount of toner in a portion of the image corresponding to second region 221B greatly differ from each other, a difference in the bulk density is caused between the developer in first region 221A and the developer in second region 221B.

Figure 27:
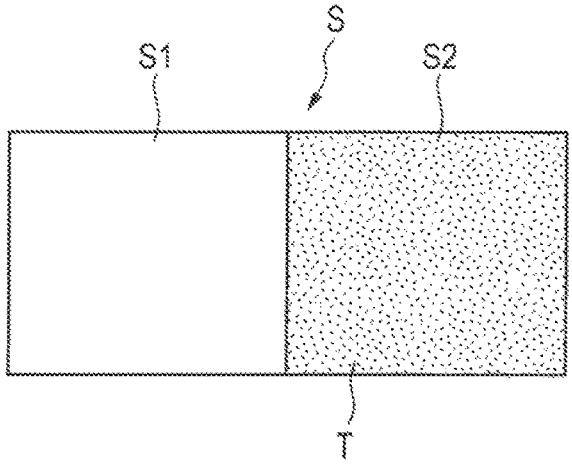
FIG. 27 illustrates a sheet on which a toner image is formed whose portions corresponding to the first and the second regions are largely different in coverage.
Figure 28:
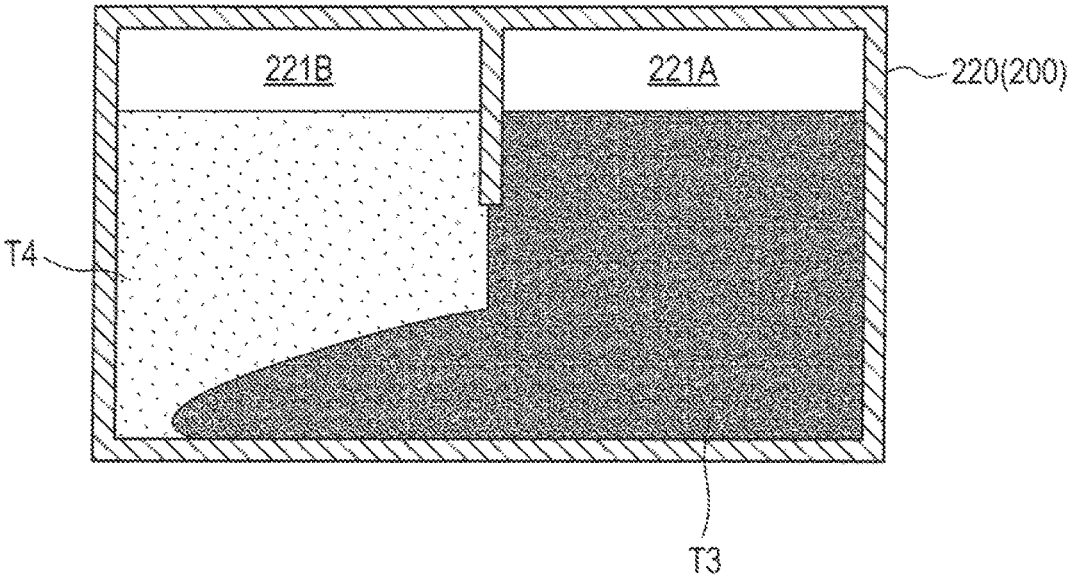
FIG. 28 is an explanatory view of a situation in which, in a case where the first and the second regions are brought into communication with each other, the developer in the respective regions is mixed up.

For example, as illustrated in FIG. 27, when toner images T are consecutively formed in which the amount of toner in portion S1 of the image corresponding to first region 221A is extremely smaller than the amount of toner in portion S2 of the image corresponding to second region 221B, toner is not used in first region 221A, and accordingly, a probability of deterioration of developer T3 in first region 221A increases, and therefore, the bulk density of developer T3 is raised as illustrated in FIG. 28. In addition, toner is used in second region 221B and fresh developer is replenished to second region 221B, so that the bulk density of developer T4 in second region 221B is lowered.

Developer T3 having a higher bulk density has a greater specific gravity and is heavier than developer T4 having a lower bulk density, so that developer T3 having a higher bulk density creeps under developer T4 having a lower bulk density when first region 221A and second region 221B in developer housing 220 are brought into communication with each other. Accordingly, the developer in first and second regions 221A and 221B forms two layers of developer T3 having a higher bulk density and developer T4 having a lower bulk density, so that the developer cannot be efficiently mixed in first and second regions 221A and 221B.

Figure 29:
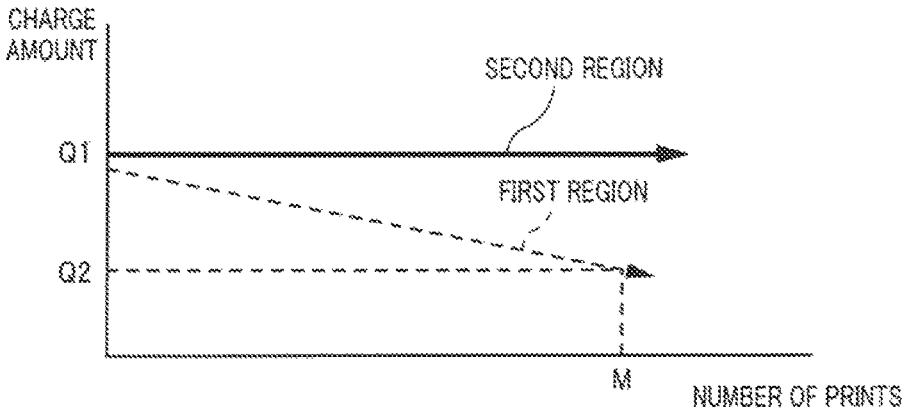
FIG. 29 shows change in the charge amount of the developer in relation to the number of prints.

In particular, the more the number of prints increases, the more the amount of deteriorated developer increases on the side of the region in which the amount of used toner is smaller. For example, in a case where toner images T illustrated in FIG. 27 are printed consecutively, the charge amount in second region 221B, which is at first charge amount Q1 (for example, 50 μc/g) at the start of printing, is not varied from first charge amount Q1 at the time when the number of prints reaches predetermined number of sheets M (for example, 10K sheets) as illustrated in FIG. 29, since second region 221B is replenished with fresh developer. In contrast, the charge amount of the developer in first region 221A decreases even to second charge amount Q2 (for example, 40 μc/g) at the time when the number of prints reaches the predetermined number of sheets M.

Figure 30:
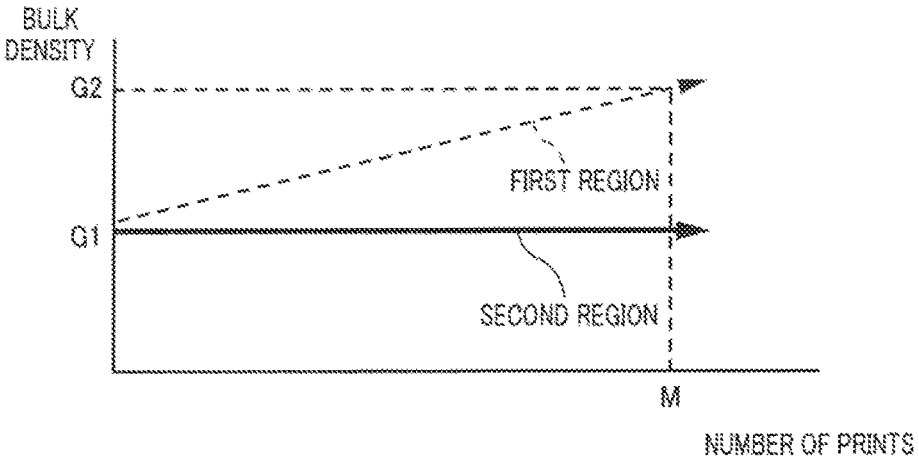
FIG. 30 shows change in the bulk density of the developer in relation to the number of prints.

When this is considered in terms of the bulk density of the developer, the bulk density in second region 221B, which is at first bulk density G1 (for example, 1.6 g/CC) at the start of printing, is not varied from first bulk density G1 at the time when the number of prints reaches the predetermined number of sheets M as illustrated in FIG. 30. In contrast, the bulk density of the developer in first region 221A increases even to second bulk density Q2 (for example, 1.9 g/CC) at the time when the number of prints reaches the predetermined number of sheets M. In this way, when a difference in the bulk density arises between first and second regions 221A and 221B, a difference in image quality also arises between portions corresponding to first and second regions 221A and 221B.

Accordingly, control section 100 controls passage formation section 260 in modification 6 depending on the bulk densities of the developer in first and second regions 221A and 221B. With such control, even if a difference in the bulk density of the developer arises between first and second regions 221A and 221B, the developer in first and second regions 221A and 221B can be mixed efficiently. Control of passage formation section 260 is described below. It is to be noted that, in descriptions in conjunction with FIGS. 31 and 32, first region 221A is a region having a lower bulk density of the developer and second region 221B is a region having a higher bulk density of the developer.

Figure 31:
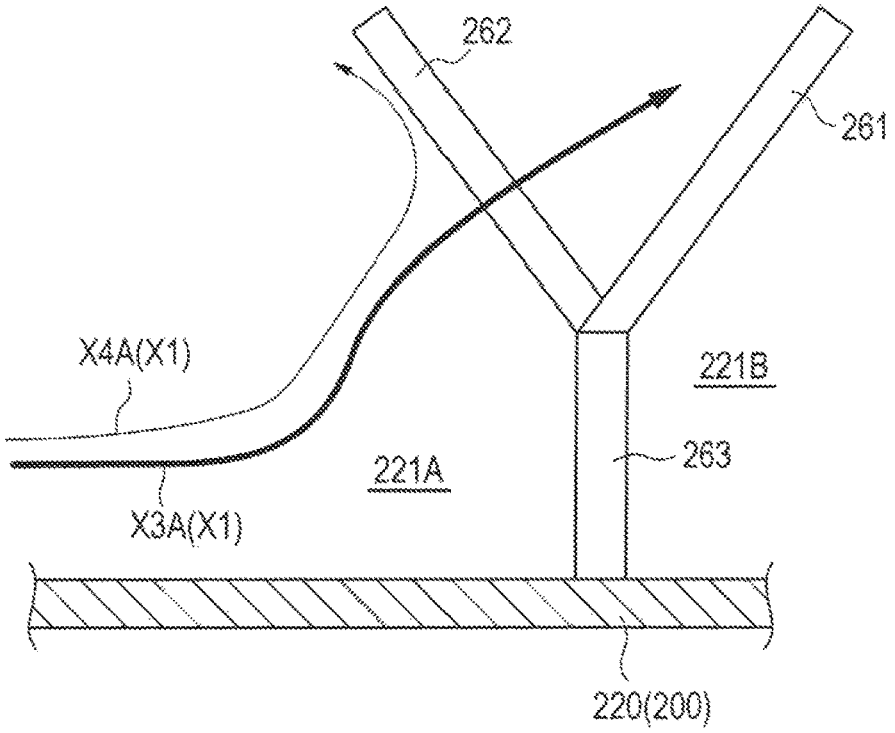
FIG. 31 is an enlarged view of the passage formation section.
Figure 32:
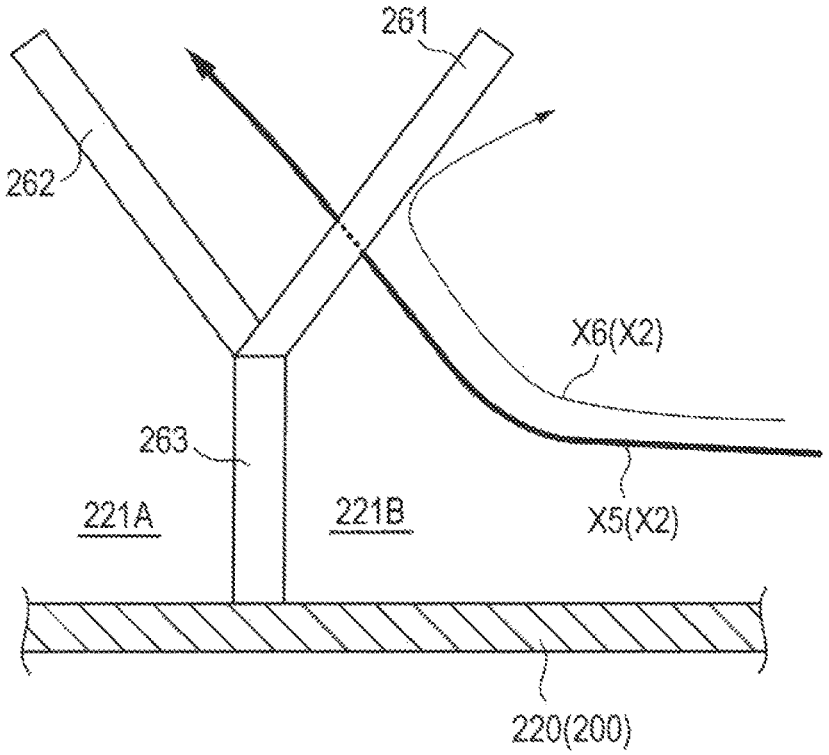
FIG. 32 is an enlarged view of the passage formation section.

As illustrated in FIGS. 31 and 32, control section 100 controls passage formation section 260 such that the developer in the region having a higher bulk density of developer (first region 221A) of first and second regions 221A and 221B moves through the first passage to the region having a lower bulk density of developer (second region 221B).

To be specific, control section 100 causes first door 261 to turn on the side of second region 221B having a lower bulk density of developer. In other words, control section 100 causes first door 261 to turn on the side of second region 221B in order to move the developer in first region 221A to second region 221B using the first passage.

Control section 100 controls passage formation section 260 such that the developer in the region having a lower bulk density of developer (second region 221B) of first and second regions 221A and 221B moves through the second passage to the region having a higher bulk density of developer (first region 221A).

To be specific, control section 100 causes second door 262 to turn on the side of first region 221A having a higher bulk density of developer. In other words, control section 100 causes second door 262 to turn on the side of first region 221A in order to move the developer in second region 221B to first region 221A using the second passage.

In this way, first and second doors 261 and 262 turn to be located on the sides of mutually different regions. The developer portions having different bulk densities can thus move between first and second regions 221A and 221B without being interfered with each other. Specific descriptions are given below for movement of each of the developer having a higher bulk density and the developer having a lower bulk density between first and second regions 221A and 221B.

To begin with, movement of the developer having a higher bulk density is described.

As illustrated in FIG. 31, the developer having a higher bulk density moves in the counterclockwise direction (arrow X1 in FIG. 25A) in first region 221A. When the developer having a higher bulk density moves to the position of passage formation section 260, the developer located at the portion corresponding to first door 261 in the up-and-down direction moves to second region 221B through the first passage above second door 262 (see arrow X3A). The developer located at the portion corresponding to second door 262 in the up-and-down direction impinges on second door 262 so as to remain in first region 221A (see arrow X4A).

Next, movement of the developer having a lower bulk density is described.

As illustrated in FIG. 32, the developer having a lower bulk density moves in the clockwise direction (arrow X2 in FIG. 25A) in second regions 221B. When the developer having a lower bulk density moves to the position of passage formation section 260, the developer located at the portion corresponding to second door 262 in the up-and-down direction moves to first region 221A through the second passage below first door 261 (see arrow X5). The developer located at the portion corresponding to first door 261 in the up-and-down direction impinges on first door 261 so as to remain in second region 221B (see arrow X6).

In this way, passage formation section 260 forms the first and second passages, so that the developer having a higher bulk density and the developer having a lower bulk density move between first and second regions 221A and 221B without interfering with each other. This can make it easier to equalize the bulk densities of developer between first and second regions 221A and 221B.

In addition, since the developer having a higher bulk density has a greater specific gravity and is heavier than the developer having a lower bulk density, the developer having a higher bulk density is moved from the first passage, which is above the second passage, to the region having a lower bulk density. Thus, the developer having a higher bulk density and having been moved to the other region sinks into the developer having a lower bulk density from above, so that it can be easier for the developer having a higher bulk density and the developer having a lower bulk density to be mixed up.

In addition, the bulk density of developer is determined by control section 100 based on a difference between first coverage K1 of the toner image supplied to developing sleeve 210 from first region 221A and second coverage K2 of the toner image supplied to developing sleeve 210 from second region 221B, for example. Then, control section 100 determines the turning directions of first and second doors 261 and 262 depending on the difference between first and second coverages K1 and K2, and determines the opening amounts of first and second doors 261 and 262 depending on this difference.

Opening angles of first and second doors 261 and 262 with respect to the boundary between first and second regions 221A and 221B may be employed as the opening amounts of first and second doors 261 and 262.

For example, when the difference between first and second coverages K1 and K2 is 30% or more and less than 50%, the opening angles of first and second doors 261 and 262 are set to 30 degrees, and when the difference between first and second coverages K1 and K2 is 50% or more, the opening angles of first and second doors 261 and 262 are set to 45 degrees.

Alternatively, control section 100 may perform control in which the turning directions and the opening amounts of first and second doors 261 and 262 are determined depending on the toner densities of the developer in first and second regions 221A and 221B.

For example, when the difference between the toner densities in first and second regions 221A and 221B is 0.5%, the opening angles of first and second doors 261 and 262 are set to 30 degrees, and when the difference between the toner densities in first and second regions 221A and 221B is 1.0%, the opening angles of first and second doors 261 and 262 are set to 45 degrees.

Figure 33:
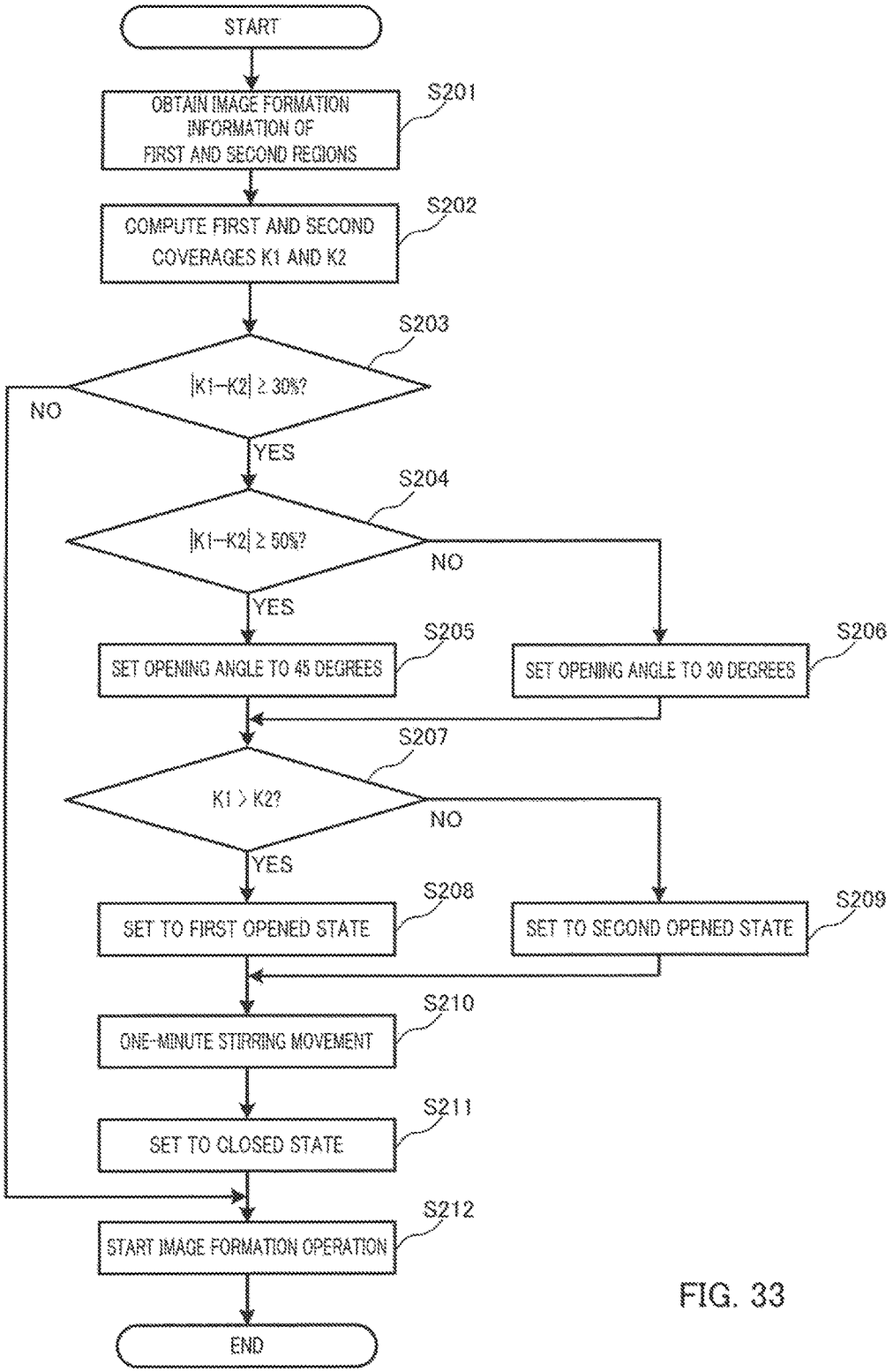
FIG. 33 is a flow chart illustrating an exemplary operation of a developer-passage switching control in the image forming apparatus.

Next, an exemplary operation of developer-passage switching control in image forming apparatus 1 is described. FIG. 33 is a flow chart of the exemplary operation of the developer-passage switching control in image forming apparatus 1. The processes in FIG. 33 are appropriately performed in a printing job.

As illustrated in FIG. 33, control section 100 obtains image formation information about first and second regions 221A and 221B (step S201). Next, control section 100 computes a difference between first and second coverages K1 and K2 from the obtained image formation information (step S202). Next, control section 100 determines whether or not the absolute value of the difference between first and second coverages K1 and K2 is 30% or more (step S203).

When the determination result indicates that the absolute value of the difference between first and second coverages K1 and K2 is less than 30% (step S203, NO), the process proceeds to step S212. In the meanwhile, when the absolute value of the difference between first and second coverages K1 and K2 is 30% or more (step S203, YES), control section 100 determines whether or not the absolute value of the difference between first and second coverages K1 and K2 is 50% or more (step S204).

When the determination result indicates that the absolute value of the difference between first and second coverages K1 and K2 is 50% or more (step S204, YES), control section 100 sets the opening angles of first and second doors 261 and 262 to 45 degrees (step S205). In the meanwhile, when the determination result indicates that the absolute value of the difference between first and second coverages K1 and K2 is less than 50% (step S204, NO), control section 100 sets the opening angles of first and second doors 261 and 262 to 30 degrees (step S206).

Control section 100 determines whether or not first coverage K1 is greater than second coverage K2 after step S205 and step S206 (step S207). When the determination result indicates that first coverage K1 is greater than second coverage K2 (step S207, YES), control section 100 sets passage formation section 260 to a first opened state so as to put passage formation section 260 into the first opened state (step S208). The first opened state is a state of when the bulk density of developer in first region 221A is lower than the bulk density of developer in second region 221B. That is, the first opened state is a state where first door 261 is located on the side of first region 221A and second door 262 is located on the side of second region 221B.

In the meanwhile, when first coverage K1 is equal to or less than second coverage K2 (step S207, NO), control section 100 sets passage formation section 260 to a second opened state so as to put passage formation section 260 into the second opened state (step S209). The second opened state is a state of when the bulk density of developer in first region 221A is higher than the bulk density of developer in second region 221B. That is, the second opened state is a state where first door 261 is located on the side of second region 221B and second door 262 is located on the side of first region 221A.

Control section 100 performs the stirring movements by first and second stirring members 222 and 223 for one minute in developer housing 220 after step S208 and step S209 (step S210).

Next, control section 100 set passage formation section 260 to the closed state so as to put passage formation section 260 into the closed state (step S211). Next, control section 100 starts image formation operation (step S212). Then, the present control is ended.

With modification 6 configured as described above, passage formation section 260 forms the first and second passages, so that the developer having a higher bulk density and the developer having a lower bulk density move between first and second regions 221A and 221B without interfering with each other. This can make it possible to efficiently equalize the bulk densities of developer between first and second regions 221A and 221B.

In addition, since the developer having a higher bulk density has a greater specific gravity and is heavier than the developer having a lower bulk density, the developer having a higher bulk density is moved from the first passage, which is above the second passage, to the region having a lower bulk density. Thus, the developer having a higher bulk density and having been moved to the other region sinks into the developer having a lower bulk density from above, so that it can be easier for the developer having a higher bulk density and the developer having a lower bulk density to be mixed up. It is thus possible to promptly equalize the bulk densities of developer between first and second regions 221A and 221B.

In addition, first and second doors 261 and 262 are provided at a place in developer housing 220 where developer housing 220 is partitioned into first and second regions 221A and 221B, and first and second regions 221A and 221B are opened and closed by first and second doors 261 and 262, so that the bulk densities of developer between first and second regions 221A and 221B can be equalized in a simple configuration.

Figure 34:
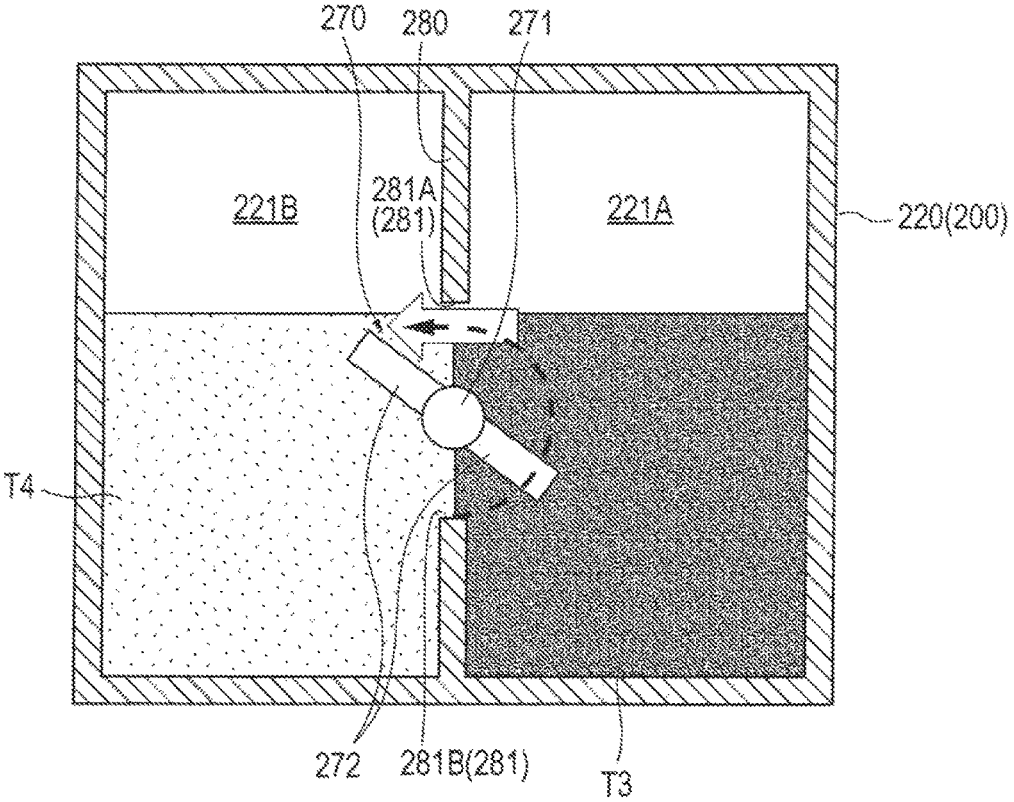
FIG. 34 is a sectional view of the vicinity of a passage formation section in a developer housing according to modification 7.

Next, passage formation section 270 according to modification 7 is described. FIG. 34 is a sectional view of the vicinity of passage formation section 270 in developer housing 220 according to modification 7. It is to be noted that illustration of first and second stirring members 222 and 223 in developer housing 220 is omitted in FIG. 34.

As illustrated in FIG. 34, developer housing 220 according to this modification includes partition section 280 serving as a partition between first region 221A from second region 221B. Partition section 280 includes opening 281 in the middle thereof in the up-and-down direction. Passage formation section 270 is provided in opening 281.

Passage formation section 270 includes rotation shaft 271 and a pair of plates 272. Rotation shaft 271 is located in the middle of opening 281 of partition section 280 in the up-and-down direction. Each of plates 272 extends from rotation shaft 271, and is configured in such a manner as to be capable of closing opening 281 on the upper or lower side of rotation shaft 271.

Passage formation section 270 brings first region 221A into communication with second region 221B when the pair of plates 272 is moved away from opening 281 by rotation of passage formation section 270 about rotation shaft 271.

To be more specific, each plate of the pair of plates 272 rotates to convey the developer in first region 221A or second region 221B to opening 281 in such a manner as to push out the developer. The rotation direction of passage formation section 270 is such that developer T3 having a higher bulk density passes through opening 281A above rotation shaft 271 (first passage) and developer T4 having a lower bulk density passes through opening 281B below rotation shaft 271 (second passage).

For example, when the bulk density of developer is higher in first region 221A than in second region 221B, passage formation section 270 rotates such that one of plates 272 located on the side of first region 221A rotates upward from below and the other one of plates 272 located on the side of second region 221B rotates downward from above.

In this way, the developer having a higher bulk density T3 in first region 221A moves to second region 221B through opening 281A above rotation shaft 271, that is, the first passage. In addition, the developer having a lower bulk density T4 in second region 221B moves to first region 221A through opening 281B below rotation shaft 271, that is, the second passage.

The rotation direction of passage formation section 270 is determined depending on a difference between first coverage K1 of the toner image corresponding to first region 221A and second coverage K2 of the toner image corresponding to second region 221B. In addition, the rotational speed of passage formation section 270 is determined depending on said difference.

For example, when the difference between first and second coverages K1 and K2 is 30% or more and less than 50%, the rotational speed of passage formation section 270 is set to 450 rpm, and when the difference of first and second coverages K1 and K2 is 50% or more, the rotational speed of passage formation section 270 is set to 600 rpm.

Alternatively, the rotation direction and rotational speed of passage formation section 270 may be determined depending on the toner densities of the developer in first and second regions 221A and 221B.

It may also be possible to control to determine the rotation time of passage formation section 270 depending on the difference between first and second coverages K1 and K2 and/or depending on the toner densities of the developer in first and second regions 221A and 221B.

In addition, the aforementioned embodiments merely describe examples of embodiments for practicing the present invention, and should not be construed as limiting the technical scope of the present invention. That is, the present invention can be embodied in various forms without departing from the spirit, scope, or principal features of the present invention.

The present invention is applicable to an image forming system composed of a plurality of units including an image forming apparatus. A plurality of units includes external apparatus, such as a post-processing apparatus, a control apparatus connected through a network, and the like.

At the end, evaluation experiments of image forming apparatus 1 according to the embodiment are described.

The effect of changing the developer circulation state into the second state was first confirmed. To be specific, toner images T illustrated in FIG. 11 were consecutively formed on 1,000 sheets, and then a halftone image was formed over the entire surface of a sheet by image forming apparatus 1, and in this condition, the halftone image was checked for occurrence of a conspicuous difference in toner density. In an example, the developer circulation state was the second state, and in a comparative example, the developer circulation state was the first state. The experimental results in the example and the comparative example are shown in table 1.

TABLE 1

| | Conspicuous Difference in Image Density |
|---|---|
| Example | Good |
| Comparative Example | Poor |

"Good" in table 1 denotes that no conspicuous difference in image density occurred. "Poor" denotes that a conspicuous difference in image density occurred.

As illustrated in table 1, in the comparative example, it was confirmed that a conspicuous difference in density of the halftone image occurred. In contrast, in the example, it was confirmed that the preferable image quality was obtained without occurrence of a conspicuous difference in density of the halftone image.

Next, effects of changing the developer circulation state into the first state were examined. To be specific, toner images T illustrated in FIG. 11 were consecutively formed on 1,000 sheets, and then a halftone image was formed over the entire surface of a sheet by image forming apparatus 1, and in this condition, the halftone image was checked for occurrence of a conspicuous difference in toner density. In addition, it was ascertained whether or not a density decrease occurred at an early stage of the consecutive image formation. In an example, the developer circulation state was the first state, and in a comparative example, the developer circulation state was the second state. The experimental results in the example and in the comparative example are shown in table 2.

TABLE 2

| | Conspicuous Difference in Image Density | Density at Early Stage |
|---|---|---|
| Example | Good | Good |
| Comparative Example | Poor | Poor |

"Good" in table 2 denotes that no conspicuous difference in image density occurred, or that no density decrease at the early stage occurred. "Poor" denotes that a conspicuous difference in image density occurred, or that a density decrease at the early stage occurred.

As illustrated in table 2, in the comparative example, it was confirmed that a conspicuous difference in density of the halftone image occurred and that a density decrease in the entire image occurred at the early stage. In contrast, in the example, it was confirmed that the preferable image quality was obtained without occurrence of a conspicuous difference in density of the halftone image and without occurrence of a density decrease in the entire image at the early stage.

Next, an evaluation experiment of developing device 200 according to modification 6 is described. In the evaluation experiment described below, image forming apparatus 1 illustrated in FIG. 2 was employed.

To begin with, toner images as illustrated in FIG. 27 in which the amount of toner in portion S1 of the image corresponding to first region 221A and the amount of toner in portion S2 of the image corresponding to second region 221B greatly differ from each other were formed on 10,000 sheets S of A3 size, and the qualities of the formed images were evaluated. Then, the stirring movements of first and second stirring members 222 and 223 were carried out, and the image quality of an image formed after the stirring movements was evaluated. In this experiment, the coverage of the toner image in portion S1 corresponding to first region 221A was set to 1%, and the coverage of the toner image in portion S2 corresponding to second region 221B was set to 30%.

In example 1, the configuration illustrated in FIGS. 25A to 26B in which passage formation section 260 is included was adopted, and in example 2, the configuration in which passage formation section 270 illustrated in FIG. 34 is included was adopted. In addition, in comparative example 1, a configuration in which first and second regions 221A and 221B are separated from each other by a partition was adopted, and in comparative example 2, a configuration in which first and second regions 221A and 221B are in communication with each other was adopted. The experimental results in examples 1 and 2 and comparative examples 1 and 2 are shown in table 3.

TABLE 3

| | Example 1 | Example 2 | Comparative Example 1 | Comparative Example 2 |
|---|---|---|---|---|
| After Image Formation on 10,000 Sheets | Poor | Poor | Poor | Poor |
| One-minute Stirring Movement | Good | Fair | Poor | Poor |
| Two-minute Stirring Movement | Good | Good | Poor | Fair |

"Good" in table 3 denotes that the preferable image in which the amount of toner supplied from first region 221A and the amount of toner supplied from second region 221B are not different from each other was obtained, "Fair" denotes that the image of a practically satisfactory level of quality was obtained, and "Poor" denotes that defects occurred in the image. The same applies to tables 2 to 4 below.

As for the image qualities evaluated after image formation on 10,000 sheets, table 3 shows that it was confirmed that an image defect occurred in all the examples and comparative examples. Then, stirring movements were performed, and, in the case where the stirring movements were performed for one minute, it was confirmed that defects occurred in the images in comparative examples 1 and 2. In addition, in the case where the stirring movements were performed for two minutes, it was confirmed that although the image quality slightly improved in comparative example 2, defects still occurred in the image in comparative example 1.

In contrast, it was confirmed that the preferable image was obtained in example 1 in both of the cases where the stirring movements were performed for one minute and for two minutes. In addition, it was confirmed in example 2 that the preferable image was obtained in the case where the stirring movements were performed for two minutes, and that the image of a practically satisfactory level of quality was obtained even in the case where the stirring movements were performed for one minute. That is, it was confirmed that the developer in first and second regions 221A and 221B was mixed up promptly by applying the present invention.

Next, toner images as illustrated in FIG. 27 in which the amount of toner in portion S1 of the image corresponding to first region 221A and the amount of toner in portion S2 of the image corresponding to second region 221B greatly differ from each other were formed on 1,000 sheets S of A3 size, and the qualities of the formed images were evaluated. In addition, the opening angles of first and second doors 261 and 262 of passage formation section 260 in aforementioned example 1 were changed to 0, 15, 30, and 45 degrees, and the stirring movements of first and second stirring members 222 and 223 were then carried out in each case of the opening angles. Then, the image qualities of images formed thereafter were evaluated.

In this experiment, the coverage of the toner image in portion S1 corresponding to first region 221A was set to 1%, and the coverage of the toner image in portion S2 corresponding to second region 221B was set to 30%. The experimental results for the respective opening angles are shown in table 4.

TABLE 4

| | Opening Angle | | | |
|---|---|---|---|---|
| Stirring Time | 0 degrees | 15 degrees | 30 degrees | 45 degrees |
| 30 seconds | Poor | Poor | Poor | Poor |
| 60 seconds | Poor | Poor | Fair | Good |
| 90 seconds | Poor | Fair | Good | Good |

According to table 4, in the case where the stirring time was 30 seconds, defects occurred in the images in every case of the opening angles. In the case where the stirring time was 60 seconds, however, defects occurred in the images of when the opening angles were 0 and 15 degrees, the image of a practically satisfactory level of quality was obtained when the opening angle was 30 degrees, and the preferable image was obtained when the opening angle was 45 degrees. Thus, it was confirmed that the developer in first and second regions 221A and 221B was mixed up promptly by setting the opening angles to 30 degrees or greater.

In addition, in the case where the stirring time was 90 seconds, the image of a practically satisfactory level of quality was obtained when the opening angle was 15 degrees, and the preferable image was obtained when the opening angle was 30 degrees. That is, it was confirmed that the image quality improved by increasing the stirring time.

Next, toner images as illustrated in FIG. 27 in which the coverage of the toner image in portion S1 corresponding to first region 221A and the coverage of the toner image in portion S2 corresponding to second region 221B differ from each other and the difference was varied in several ways were formed on 1,000 sheets S of A3 size, respectively for the varied differences, and the qualities of the formed images were evaluated for each case of the varied differences. In addition, the opening angles of first and second doors 261 and 262 of passage formation section 260 in aforementioned example 1 were set to 45 degrees, and the stirring movements of first and second stirring members 222 and 223 were then carried out. Then, the qualities of images formed thereafter were evaluated. The experimental results for the varied differences in coverage are shown in table 5.

TABLE 5

| | Difference in Coverage | | | |
|---|---|---|---|---|
| Stirring Time | 15% | 30% | 50% | 70% |
| 30 seconds | Fair | Fair | Poor | Poor |
| 60 seconds | Good | Good | Good | Good |
| 90 seconds | Good | Good | Good | Good |

According to table 5, it was confirmed that in the case where the stirring time was 30 seconds, defects occurred in the images when the difference in coverage was 50% or more. It was confirmed, however, that in the case where the stirring time was 60 seconds or longer, the preferable images were obtained in every case of the differences in coverage. Thus, it was confirmed that the stirring time needs to be more than 60 seconds (one minute).

Lastly, toner images as illustrated in FIG. 27 in which the amount of toner in portion S1 of the image corresponding to first region 221A and the amount of toner in portion S2 of the image corresponding to second region 221B greatly differ from each other were formed on 1,000 sheets S of A3 size, and the qualities of the formed images were evaluated. In addition, the stirring movements of first and second stirring members 222 and 223 were carried out in which the rotational speed of passage formation section 270 in aforementioned example 2 was changed to 225, 450, and 600 rpm, and the quality of an image formed thereafter was evaluated for each case of the rotational speeds. In the meantime, a configuration in which first and second regions 221A and 221B are separated from each other by a partition was adopted in a comparative example.

In this experiment, the coverage of the toner image in portion S1 corresponding to first region 221A was set to 1%, and the coverage of the toner image in portion S2 corresponding to second region 221B was set to 30%. The experimental results for the respective rotational speeds are shown in table 6.

TABLE 6

| | Rotational Speed | | | Comparative |
|---|---|---|---|---|
| Stirring Time | 225 rpm | 450 rpm | 600 rpm | Example |
| 30 seconds | Poor | Poor | Poor | Poor |
| 60 seconds | Poor | Fair | Good | Poor |
| 90 seconds | Fair | Good | Good | Poor |

According to table 6, it was confirmed in the comparative example that defects occurred in the images in every case of the varied stirring times. In contrast, in the cases where the different rotational speeds of passage formation section 270 were applied, it was confirmed that defects occurred in the images in every case of the rotational speeds when the stirring time was 30 seconds, the image of a practically satisfactory level of quality was obtained when the stirring time was 60 seconds and the rotational speed was 450 rpm, and the preferable images were obtained when the stirring time was 60 seconds and the rotational speed was 600 rpm. That is, it was confirmed that, when the stirring time was set to 60 seconds (one minute), a rotational speed of passage formation section 270 of 450 rpm or more is desirable.

In addition, it was confirmed that the image of a practically satisfactory level of quality was obtained when the stirring time was set to 90 seconds and when the rotational speed was 225 rpm, and that the preferable images were obtained when the stirring time was set to 90 seconds and when the rotational speed was 450 rpm or more. That is, it was confirmed that the image quality improves further by increasing the stirring time.

Although embodiments of the present invention have been described and illustrated in detail, it is clearly understood that the same is by way of illustration and example only and not limitation, the scope of the present invention should be interpreted by terms of the appended claims.

What is claimed is:

1. A developing device comprising:

a developer bearing member that bears developer;

a developer housing that stores the developer to be supplied to the developer bearing member, the developer housing including a first region on one side in an axial direction of the developer bearing member and a second region on the other side; and a hardware processor that performs control in which a developer circulation state is switched between a first state and a second state depending on states of the developer in the first and the second regions, the first state being a state in which a developer circulation path is formed in each of the first and the second regions, the second state being a state in which a single developer circulation path is formed through both of the first and the second regions, wherein both of the first region and the second region face the developer bearing member.

2. The developing device according to claim 1, wherein: the developer circulation path in the second state is formed annularly.

3. The developing device according to claim 1, further comprising:

a toner density detector that detects a toner density in the developer housing, wherein:

when the developer circulation state is the second state, the hardware processor determines, depending on a difference between toner densities in the first and the second regions detected by the toner density detector, whether or not the developer circulation state is to be changed from the second state to the first state.

4. The developing device according to claim 3, further comprising:

a toner replenisher that replenishes the developer housing with toner, wherein:

when the developer circulation state is changed from the second state to the first state, the hardware processor controls the toner replenisher such that an amount of toner to be replenished to one of the first and the second regions in which an amount of toner consumption is greater is increased.

5. The developing device according to claim 1, further comprising:

a liquid level detector that detects a liquid level of the developer in the developer housing, wherein:

when the developer circulation state is the first state, the hardware processor determines, depending on a difference between the liquid levels in the first and the second regions detected by the liquid level detector, whether or not the developer circulation state is to be changed from the first state to the second state.

6. The developing device according to claim 1, wherein:

the hardware processor switches the developer circulation state between the first and the second states depending on a difference between the amount of developer supplied from the first region to the developer bearing member and the amount of developer supplied from the second region to the developer bearing member.

7. The developing device according to claim 1, further comprising:

a first stirrer that rotates to stir developer in the first region of the developer housing; and a second stirrer that rotates to stir developer in the second region of the developer housing, wherein the hardware processor controls rotation directions of the first and the second stirrers such that a circulation direction of the developer in the first region differs from a circulation direction of the developer in the second region, when the developer circulation state is the first state.

8. The developing device according to claim 7, wherein:

the hardware processor changes the rotation direction of one of the first and the second stirrers when the developer circulation state is changed from the first state to the second state.

9. The developing device according to claim 1, further comprising:

a first stirrer that rotates to stir developer in the first region of the developer housing; and a second stirrer that rotates to stir developer in the second region of the developer housing, wherein the hardware processor controls rotation directions of the first and the second stirrers such that a circulation direction of the developer in the first region is the same as a circulation direction of the developer in the second region, when the developer circulation state is the first state.

10. The developing device according to claim 7, wherein:

the hardware processor controls rotational frequencies of the first and the second stirrers.

11. The developing device according to claim 1, further comprising:

a communication state switcher that switches between a communicated state and non-communicated state between the first and the second regions, wherein:

the hardware processor switches the developer circulation state between the first and the second states by controlling the communication state switcher to switch between the communicated and non-communicated states between the first and the second regions.

12. The developing device according to claim 1, further comprising:

a first stirrer that rotates to stir developer in the first region of the developer housing;

a second stirrer that rotates to stir developer in the second region of the developer housing; and a developer discharger that discharges the developer in the developer housing, wherein the hardware processor controls the first and the second stirrers such that the developer moves toward the developer discharger, when the developer circulation state is the second state.

13. The developing device according to claim 1, further comprising:

a passage former that forms a first passage and a second passage, the first passage being a passage through which the developer in one of the first and the second regions in which a bulk density of the developer is higher moves to the other in which a bulk density of the developer is lower, the second passage being a passage through which the developer in the region in which the bulk density of the developer is lower moves to the region in which the bulk density of developer is higher, wherein:

the hardware processor switches the developer circulation state by controlling the passage former such that the first and the second passages are formed depending on the bulk densities of the developer in the first and the second regions.

14. The developing device according to claim 13, wherein:

the passage former serves as a partition between the first and the second regions in the developer housing, the passage former includes:

a first door that is moved such that the first and the second regions are opened, thereby forming the first passage, or such that the first and the second regions are closed, thereby not forming the first passage; and a second door located below the first door, the second door being moved such that the first and the second regions are opened, thereby forming the second passage, or such that the first and the second regions are closed, thereby not forming the second passage, and the hardware processor causes the first and the second doors to open or close depending on the bulk densities of the developer in the first and the second regions.

15. The developing device according to claim 14, wherein:

the first and the second doors are turnable on a side of the first region and on a side of the second region with respect to a boundary between the first and the second regions, and in a case where developer in one of the first and the second regions is moved to the other region via one of the first and the second passages, the hardware processor causes the first or the second door to turn on the side of the other region.

16. The developing device according to claim 15, wherein:

the hardware processor determines respective turning directions of the first and the second doors depending on a difference between a coverage of a toner image supplied from the first region to the developer bearing member and a coverage of a toner image supplied from the second region to the developer bearing member.

17. The developing device according to claim 16, wherein:

the hardware processor determines opening amounts of the first and the second doors depending on the difference between the coverage of the toner image supplied from the first region to the developer bearing member and the coverage of the toner image supplied from the second region to the developer bearing member.

18. The developing device according to claim 15, further comprising:

a toner density detector that detects toner densities of the developer in the first and the second regions, wherein the hardware processor determines respective turning directions of the first and the second doors depending on the toner densities detected by the toner density detector.

19. The developing device according to claim 18, wherein:

the hardware processor determines opening amounts of the first and the second doors depending on the toner densities detected by the toner density detector.

20. The developing device according to claim 13, further comprising:

a partition between the first and the second regions in the developer housing, the partition including in a middle of the partition in an up-and-down direction an opening that brings the first and the second regions into communication with each other, wherein the passage former includes:

a rotation shaft provided in a middle of the opening in the up-and-down direction; and a pair of plates extending from the rotation shaft, the pair of plates being capable of closing the opening, and the hardware processor causes the passage former to rotate and thereby to form the first and the second passages.

21. The developing device according to claim 20, wherein:

the hardware processor determines a rotation direction of the passage former depending on a difference between a coverage of a toner image supplied from the first region to the developer bearing member and a coverage of a toner image supplied from the second region to the developer bearing member.

22. The developing device according to claim 21, wherein:

the hardware processor determines a rotation speed of the passage former depending on the difference between the coverage of the toner image supplied from the first region to the developer bearing member and the coverage of the toner image supplied from the second region to the developer bearing member.

23. The developing device according to claim 21, wherein:

the hardware processor determines a rotation time of the passage former depending on the difference between the coverage of the toner image supplied from the first region to the developer bearing member and the coverage of the toner image supplied from the second region to the developer bearing member.

24. The developing device according to claim 20, further comprising:

a toner density detector that detects toner densities of the developer in the first and the second regions, wherein the hardware processor determines a rotation direction of the passage former depending on the toner densities detected by the toner density detector.

25. The developing device according to claim 24, wherein:

the hardware processor determines a rotation speed of the passage former depending on the toner densities detected by the toner density detector.

26. The developing device according to claim 24, wherein:

the hardware processor determines a rotation time of the passage former depending on the toner densities detected by the toner density detector.

27. An image forming apparatus comprising:

a developer bearing member that bears developer;

a developer housing that stores the developer to be supplied to the developer bearing member, the developer housing including a first region on one side in an axial direction of the developer bearing member and a second region on the other side; and a hardware processor that performs control in which a developer circulation state is switched between a first state and a second state depending on states of the developer in the first and the second regions, the first state being a state in which a developer circulation path is formed in each of the first and the second regions, the second state being a state in which a single developer circulation path is formed through both of the first and the second regions, wherein both of the first region and the second region face the developer bearing member.

* * * * *